US007118383B2

(12) United States Patent
Nagata et al.

(10) Patent No.: US 7,118,383 B2
(45) Date of Patent: Oct. 10, 2006

(54) COAXIAL CONNECTOR FOR BOARD-TO-BOARD CONNECTION

(75) Inventors: Takayuki Nagata, Osaka (JP); Toru Imai, Osaka (JP)

(73) Assignee: Hosiden Corporation, Yao (JP)

( * ) Notice: Subject to any disclaimer, the term of this patent is extended or adjusted under 35 U.S.C. 154(b) by 0 days.

(21) Appl. No.: 11/189,706

(22) Filed: Jul. 27, 2005

(65) Prior Publication Data

US 2006/0024985 A1 Feb. 2, 2006

(30) Foreign Application Priority Data

Jul. 27, 2004 (JP) ..... 2004-218212
Apr. 13, 2005 (JP) ..... 2005-115423

(51) Int. Cl.
*H01R 1/00* (2006.01)

(52) U.S. Cl. ..... 439/63; 439/581

(58) Field of Classification Search ..... 439/63, 439/74, 83, 581, 582, 851, 842, 858
See application file for complete search history.

(56) References Cited

U.S. PATENT DOCUMENTS 5,380,211 A * 1/1995 Kawaguchi et al. ..... 439/74
5,807,116 A * 9/1998 Kitatani et al. ..... 439/63
6,338,634 B1 * 1/2002 Yu ..... 439/83
6,474,995 B1 * 11/2002 Wu ..... 439/63
6,776,668 B1 * 8/2004 Scyoc et al. ..... 439/700

FOREIGN PATENT DOCUMENTS

JP 6-314580 11/1994
JP 8-236227 9/1996
JP 2001-518231 A 10/2001

* cited by examiner

*Primary Examiner*—Briggitte Hammond
*Assistant Examiner*—X. Chung-Trans
(74) *Attorney, Agent, or Firm*—Bacon & Thomas

(57) ABSTRACT

In the invention providing a board-to-board coaxial connector, a contact portion 17 is formed in an internal conductor housing portion 12 of a plug body 9 into which a receptacle center conductor 7 is to be inserted. The contact portion has: a stationary contact piece portion 10*b* which is perpendicularly bent from a solder connecting portion 10*a* of a plug internal conductor 10 to extend in the axial direction of the connector; and movable contact piece portions 10*c* which are continuous to the stationary contact piece portion, which are juxtaposed in a circumferential direction of the connector, and which extend in the axial direction of the connector.

10 Claims, 15 Drawing Sheets

COAXIAL CONNECTOR FOR BOARD-TO-BOARD CONNECTION

BACKGROUND OF THE INVENTION

1. Field of the Invention

The present invention relates to a board-to-board coaxial connector which electrically connects two printed circuit boards with each other in various electronic apparatuses such as a communication apparatus or a computer.

2. Description of the Prior Art

In various electronic apparatuses such as a communication apparatus or a computer, in order to realize transmission of a high-frequency signal between two printed circuit boards which are placed in substantially parallel to each other, conventionally, a method has been employed in which coaxial connector receptacles are surface mounted on the printed circuit boards, respectively, and the receptacles are connected by a coaxial jumper cable of a predetermined length having L-type coaxial connector plugs. The connector plugs are disposed at the both ends, and fittable to the coaxial connector receptacles, respectively. However, the method has defects such as that the number of parts is large, that a space for housing the jumper cable must be assured, and that a fitting work must be conducted on the two sets of coaxial connector pairs.

Board-to-board coaxial connectors for, without using a jumper cable, electrically connecting two printed circuit boards which are placed in substantially parallel to each other have been proposed. For example, Japanese Patent Application Laying-Open No. 6-314580 discloses a coaxial connector consisting of a male connector and a female connector. The male connector is fixed by surface mounting a leg of a male terminal pressingly inserted into a housing, onto a grounding conductor of one circuit board. By contrast, the female connector is fixed by surface mounting a leg portion of a female terminal pressingly inserted into a housing, onto a grounding conductor of another circuit board. The connectors are fitted with each other. A conductive screw is inserted from a bolt insertion hole of the one circuit board, passed through a middle portion of the coaxial connector, and then screwed with a screw hole of the other circuit board to be fixed thereto. A head portion of the conductive screw is in press contact with a signal conductor of the one circuit board, and an external thread portion of the conductive screw is in contact with an internal thread portion which is electrically continuous to a signal conductor of the other circuit board, so that the conductive screw serving as a center conductor electrically connects together the signal conductors of the circuit boards. Japanese Patent Application Laying-Open No. 8-236227 discloses another coaxial connector consisting of: a spring type contact pin which is held by an insulation holder, and in which a contact terminal in a basal end portion is connected to a signal circuit of one circuit board, and an end portion of the contact pin in a tip end portion is elastically contacted with a signal circuit of another circuit board in the axial direction of the connector; and a spring type contact plug which is held by an insulation holder so as to surround the spring type contact pin, and in which a contact terminal in a basal end portion is connected and fixed to a ground circuit of the one circuit board, and an end portion of the contact plug in a tip end portion is elastically contacted with a ground circuit of the other circuit board in the axial direction of the connector. International Patent Publication No. 2001-518231 discloses a coaxial connector having a first connector and a second connector. The first connector has an internal contact in which the tip end butts directly against an internal circuit trace of another circuit board in the axial direction of the connector, and which is elastically movable in the axial direction. The second connector has an external conductor which is surface mounted and fixed onto an external circuit trace of the other circuit board to be fittingly connected to an external connector of the first connector.

SUMMARY OF THE INVENTION

In the conventional board-to-board coaxial connectors, the center conductor (the conductive screw, the contact pin, the internal contact) is in contact with the counter contact portion in the axial direction of the connector and only in one face or one point. Therefore, the allowable range for dispersions of the relative distance of the two printed circuit boards, and of the relative position along the board faces is small, and a high attachment position accuracy is requested. Even when the relative distance and position are within the allowable range, instantaneous disconnection due to vibrations, an impact of dropping, or the like easily occurs, and there is a problem in that the contact reliability of the center conductor with respect to the counter contact portion is low.

The invention has been conducted in view of the above-discussed circumstances. It is an object of the invention to provide a novel board-to-board coaxial connector in which the allowable range for dispersions of the relative distance of two printed circuit boards, and of the relative position along the board faces is large, the relative distance and position are tolerated so that instantaneous disconnection due to vibrations, an impact of dropping, or the like does not occur, and the contact reliability of a center conductor and a counter contact portion is excellent.

The board-to-board coaxial connector of the invention is a board-to-board coaxial connector which is configured by one coaxial connector pair consisting of: a coaxial connector receptacle which is to be surface mounted to one printed circuit board; and a coaxial connector plug which is to be surface mounted to another printed circuit board, the coaxial connector receptacle and the coaxial connector plug being fittable with each other, wherein a contact portion is formed in an internal conductor housing portion of an insulative plug body into which a pin-like receptacle center conductor is to be inserted, the contact portion has: a stationary contact piece portion which is perpendicularly bent from a solder connecting portion of a plug internal conductor to extend in an axial direction of the connector; and movable contact piece portions which are continuous to the stationary contact piece portion, which are juxtaposed in a circumferential direction of the connector, and which extend in the axial direction of the connector, and, when the receptacle center conductor is inserted into the internal conductor housing portion, the movable contact piece portions are elastically displaced in a direction perpendicular to the axial direction of the connector to be elastically contacted with an outer circumferential face of the receptacle center conductor, together with the stationary contact piece portion.

In the thus configured board-to-board coaxial connector, fitting contact between a receptacle outer circumference conductor and a plug external conductor causes ground patterns of the printed circuit boards to be electrically connected with each other, and the contact between the receptacle center conductor and the plug internal conductor causes the signal patterns of the printed circuit boards to be electrically connected with each other, whereby a signal line required for transmitting a high-frequency signal or the like, and a shield line covering the outer circumference of the signal line are formed approximately coaxially to realize transmission of a high-frequency signal or the like between the two printed circuit boards. In the contact portion of the plug internal conductor, the movable contact piece portions are elastically displaced in a direction perpendicular to the axial direction of the connector (the axial direction of the pin-like receptacle center conductor) to be elastically contacted with the outer circumferential face of the receptacle center conductor, together with the stationary contact piece portion, i.e., the receptacle center conductor is in multipoint contact with the plug internal conductor in a direction perpendicular to the axial direction of the connector. Therefore, the allowable ranges with respect to the difference in the insertion stroke of the receptacle center conductor due to variation of the relative distance between the two printed circuit boards, and dispersion of fitting heights of the coaxial connector pair can be increased. Furthermore, also the allowable range with respect to the axis deviation (offcenter) of the coaxial connector receptacle and the coaxial connector plug caused by dispersion of relative positions of the two printed circuit board in the direction along the board face can be increased. Moreover, within the allowable ranges, instantaneous disconnection due to vibrations, an impact of dropping, or the like hardly occurs, and such dispersions can be allowed without lowering the contact reliability of the receptacle center conductor and the plug internal conductor.

In the board-to-board coaxial connector of the invention, preferably, each of the movable contact piece portions is formed into an L-like shape by: a continuous piece which is bent at an acute angle from corresponding one of both side edges of the stationary contact piece portion to extend in a direction perpendicular to the axial direction of the connector; and a contact piece which extends from the continuous piece in the axial direction of the connector, and the contact portion is formed by the stationary contact piece portion and the movable contact piece portions into a triangular shape as seen in the axial direction of the connector.

According to the configuration, the receptacle center conductor can be surrounded in a balanced manner by the three contact pieces of the plug internal conductor contact portion, and the contact pieces can be stably contacted. Therefore, the contact reliability of the receptacle center conductor and the plug internal conductor can be enhanced.

In the board-to-board coaxial connector of the invention, preferably, an inner edge of a tip end portion of each of the movable contact piece portions is chamfered to form a guiding face for insertion of the receptacle center conductor in the tip end portion of the movable contact piece portion.

According to the configuration, each of the movable contact piece portions can be formed into a flat shape over a range from the basal end to the tip end, and hence the movable contact piece portion can be prevented from being plastically deformed by prying when the receptacle center conductor is inserted.

In the board-to-board coaxial connector of the invention, preferably, a shape of the internal conductor housing portion is substantially identical with an outer shape of the contact portion after elastic displacement when the receptacle center conductor is inserted.

According to the configuration, a side wall of the internal conductor housing portion has a form along the movable contact piece portions after elastic displacement. Therefore, the movable contact piece portions can be prevented from being plastically deformed by prying when the receptacle center conductor is inserted.

In the board-to-board coaxial connector of the invention, preferably, a cylindrical contact portion of a plug external conductor which is to be in contact with a receptacle outer circumference conductor is provided with a plurality of slits to be split into plural contact piece portions which are elastically displaceable in a radial direction of the connector, and the contact portion with respect to the receptacle outer circumference conductor is formed on an inner face of a tip end side of each of the contact piece portions, the contact portion protruding inwardly.

According to the configuration, the contact portions which are to be in contact with the receptacle outer circumference conductor are formed on the inner face of the plug external conductor. Therefore, the outer diameter of the receptacle outer circumference conductor can be reduced, so that the whole coaxial connector receptacle can be miniaturized.

In the board-to-board coaxial connector of the invention, preferably, a tip end of the plug body protrudes from a tip end of the plug external conductor.

According to the configuration, when the axis deviation is within the guidance of the insertion hole, the coaxial connector receptacle and the coaxial connector plug can be fitted with each other while the receptacle center conductor is guided to the center. By contrast, when the axis deviation exceeds the guidance of the insertion hole, the tip end of the plug body protruding from the tip end of the plug external conductor interferes with the receptacle center conductor or the receptacle outer circumference conductor, and hence there is no possibility that the contact piece portions of the plug external conductor are bent or deformed. The spring function of each of the contact piece portions can be prevented from degrading or disappearing, and an excellent contact reliability of the receptacle outer circumference conductor with respect to the plug external conductor can be obtained.

As apparent from the above description, transmission of a high-frequency signal or the like between two printed circuit boards which are placed in substantially parallel to each other is realized by one pair of coaxial connectors of a coaxial connector receptacle and a coaxial connector plug which are fittable with each other, without using a jumper cable.

Furthermore, the receptacle center conductor is in multipoint contact with the contact portion of the plug internal conductor which is a counter connecting portion, in a direction perpendicular to the axial direction of the connector. Therefore, it is possible to provide a novel board-to-board coaxial connector in which the allowable range for dispersions of the relative distance of two printed circuit boards, and of the relative position along the board faces is made large, the relative distance and position are tolerated so that instantaneous disconnection due to vibrations, an impact of dropping, or the like does not occur, and the contact reliability of the receptacle center conductor and the plug internal conductor is excellent.

Moreover, the movable contact piece portion can be prevented from being plastically deformed by prying when the receptacle center conductor is inserted. Therefore, it is possible to provide a novel board-to-board coaxial connector in which the contact reliability of the receptacle center conductor and the plug internal conductor is excellent, and which is more practical.

Figure 1:
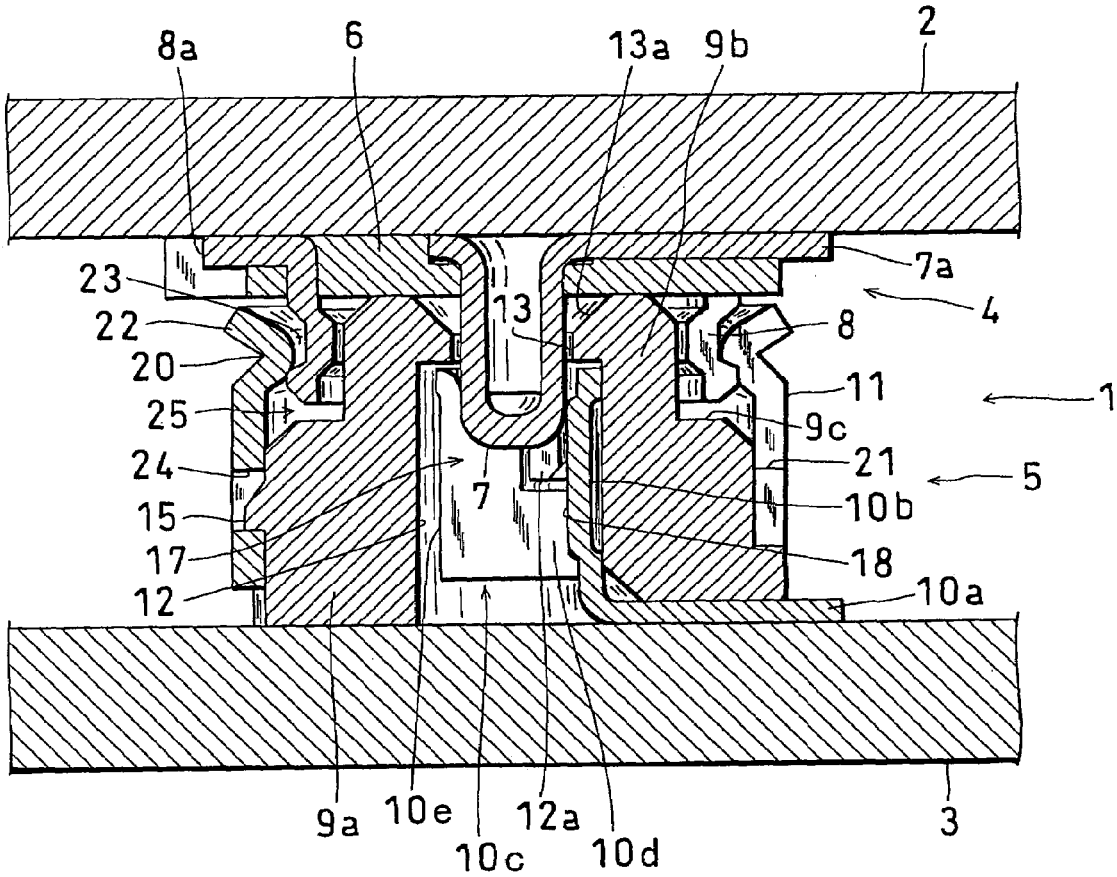
FIG. 1 is a longitudinal side sectional view showing a board connecting state using a board-to-board coaxial connector of an embodiment of the invention.

1 coaxial connector
2, 3 printed circuit board
4 coaxial connector receptacle
5 coaxial connector plug
7 receptacle center conductor
8 receptacle outer circumference conductor
9, 9' plug body
10, 10' plug internal conductor
10*a* solder connecting portion
10*b* stationary contact piece portion
10*c* movable contact piece portion
10*d* continuous piece
10*e* contact piece
11 plug external conductor
12, 12' internal-conductor housing portion
13 insertion hole
17 contact portion
19, 19' guiding face
21 slit
22 contact piece portion
23 contact portion

DESCRIPTION OF THE PREFERRED EMBODIMENT

Hereinafter, an embodiment of the invention will be described with reference to FIGS. 1 to 16.

Figure 2:
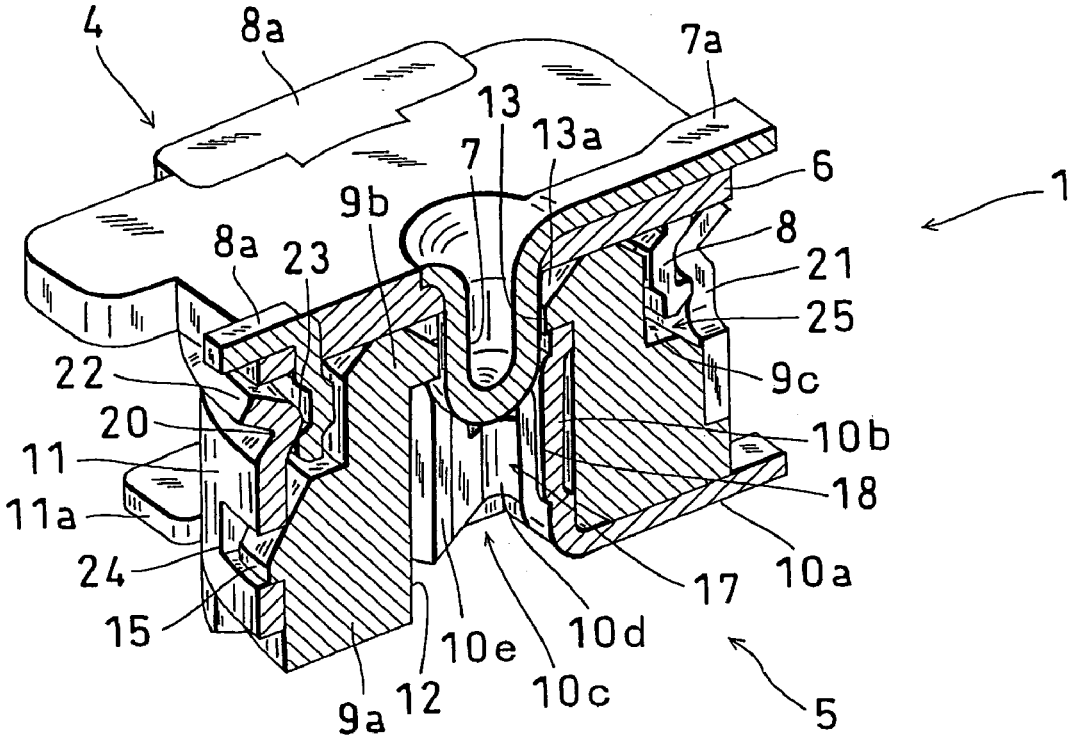
FIG. 2 is a longitudinal perspective sectional view of the board-to-board coaxial connector.
Figure 3:
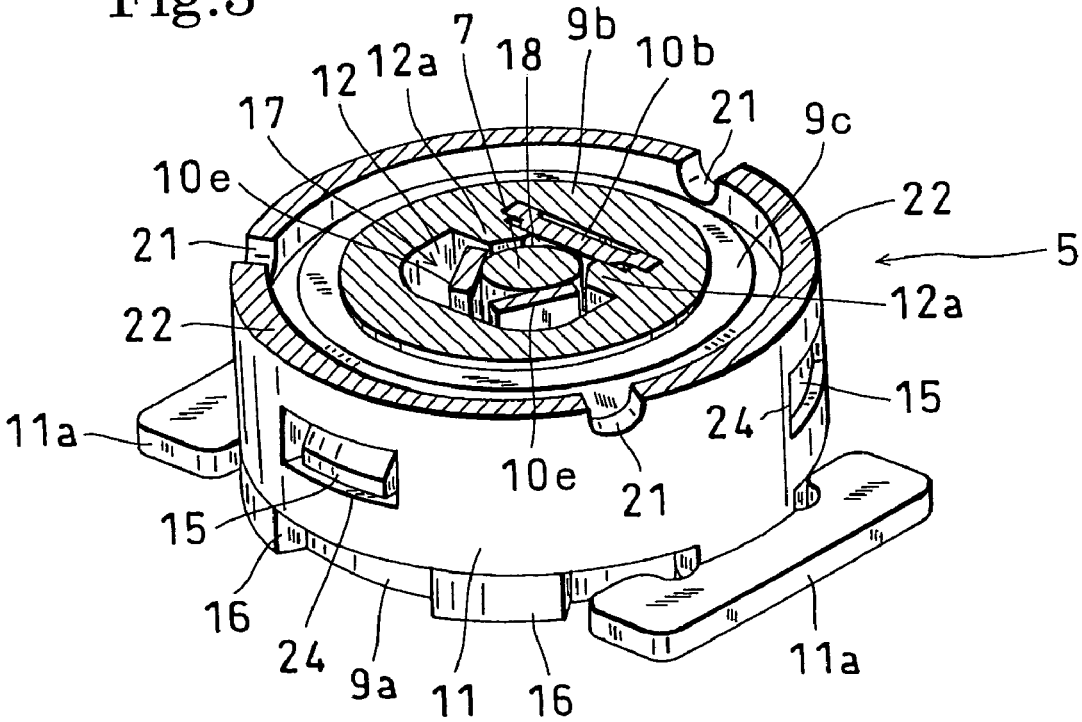
FIG. 3 is a transverse perspective sectional view of the board-to-board coaxial connector.
Figure 4:
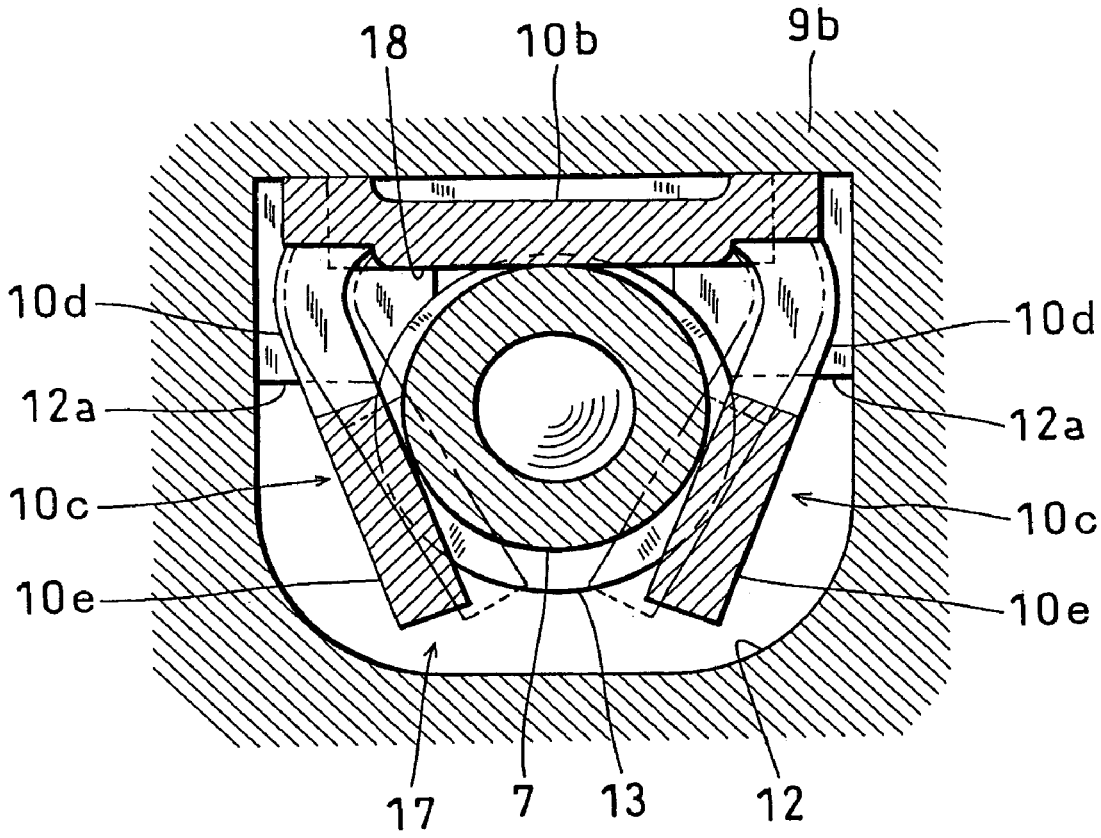
FIG. 4 is a partial enlarged transverse plan sectional view showing a contacting state between a receptacle center conductor and a plug internal conductor of the board-to-board coaxial connector.
Figure 5:
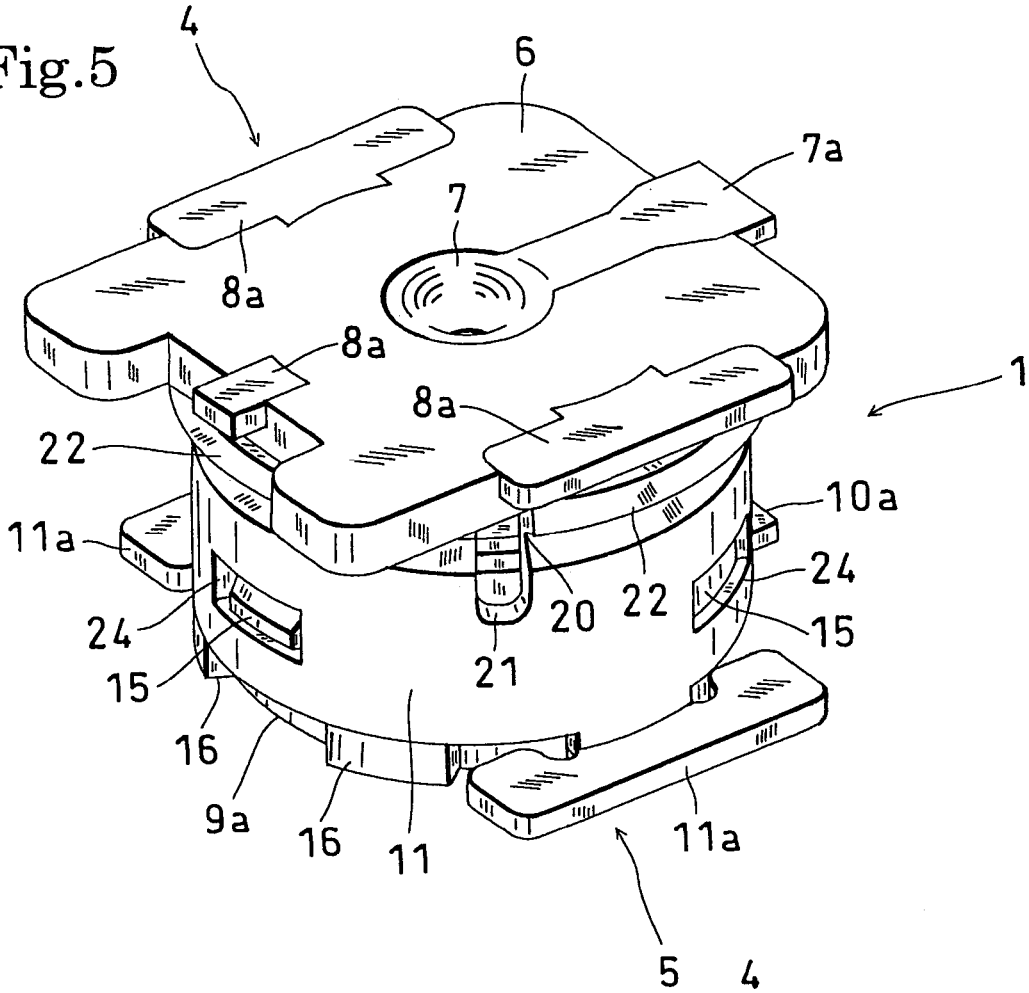
FIG. 5 is an external perspective view of the board-to-board coaxial connector.

As shown in FIG. 1, a board-to-board coaxial connector (hereinafter, referred to as "coaxial connector") 1 of the embodiment is used for electrically connecting together two printed circuit boards (hereinafter, referred to as "board") 2, 3 which are separated by a predetermined gap, and which are placed in substantially parallel to each other. As shown in FIGS. 2 and 5 also, the coaxial connector is configured by one pair of coaxial connectors which are fittable to and separable from each other, i.e., a coaxial connector receptacle (hereinafter, referred to as "receptacle") 4 which is to be surface mounted on the one board 2, and a coaxial connector plug (hereinafter, referred to as "plug") 5 which is to be surface mounted on the other board 3.

Figure 6:
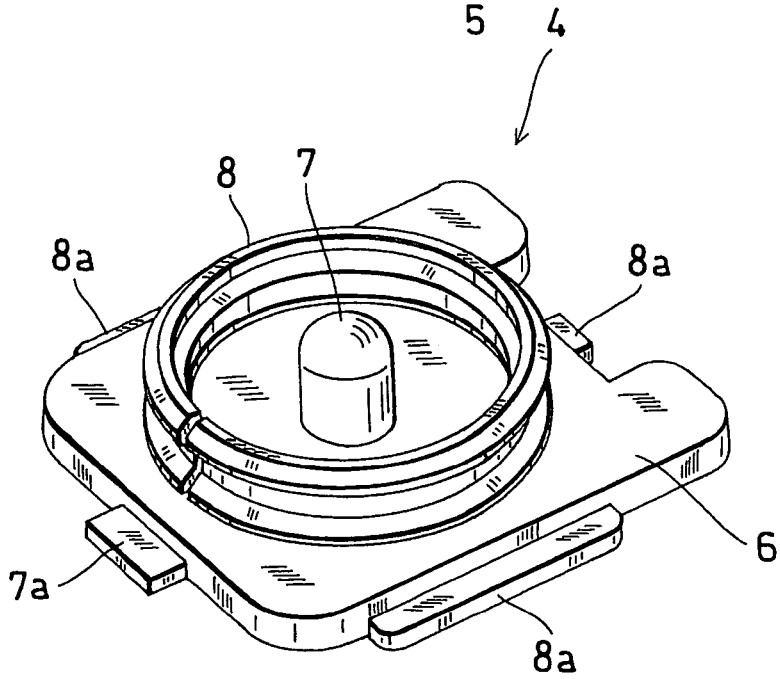
FIG. 6 is an external perspective view of a coaxial connector receptacle of the board-to-board coaxial connector.
Figure 7A:
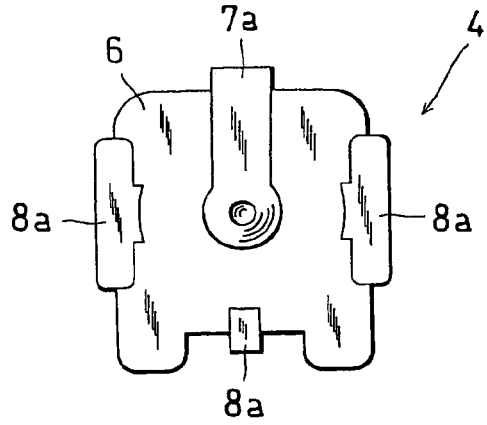
FIG. 7 is a drawing showing the coaxial connector receptacle of the board-to-board coaxial connector in which (a) is a bottom view, (b) is a rear view, (c) is a plan view, (d) is a sectional view taken along the line A—A of the plan view, and (e) is a side view.
Figure 7B:
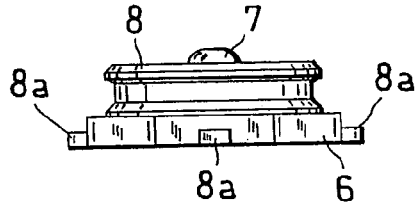
Figure 7C:
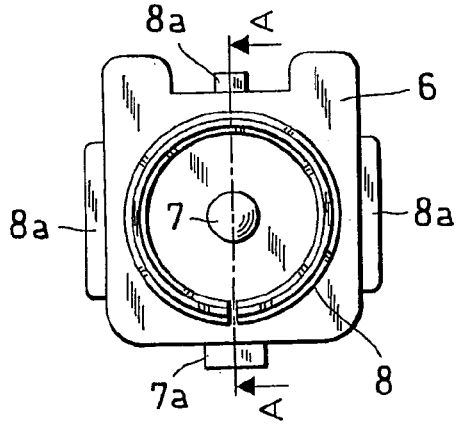
Figure 7D:
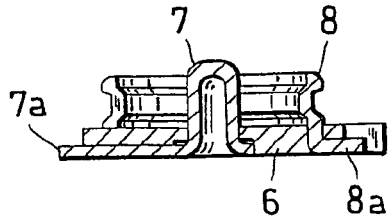
Figure 7E:
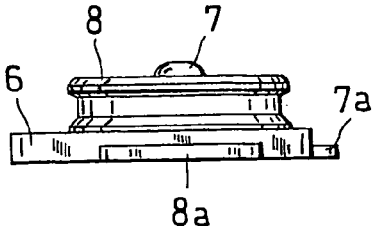
Figure 8A:
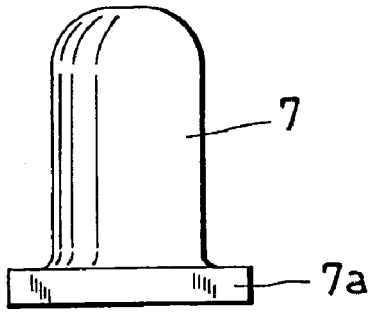
FIG. 8 is a drawing showing the receptacle center conductor of the board-to-board coaxial connector in which (a) is a front view, (b) is a bottom view, and (c) is a side view.
Figure 8B:
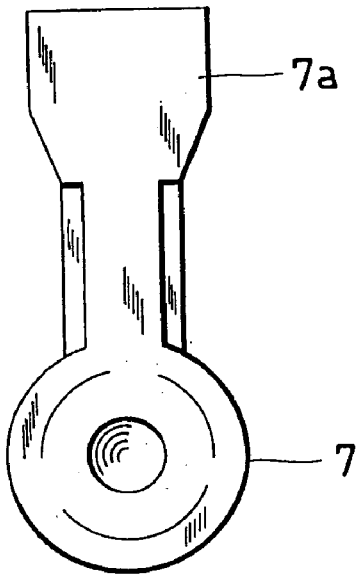
Figure 8C:
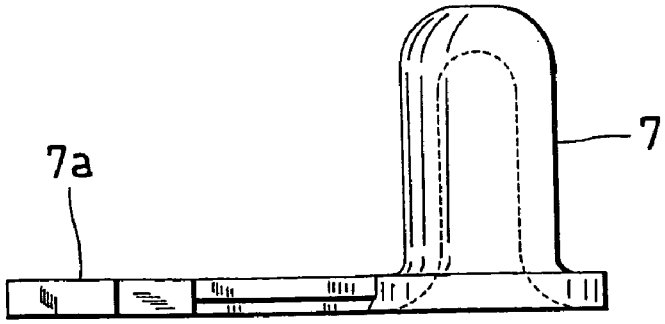
Figure 9A:
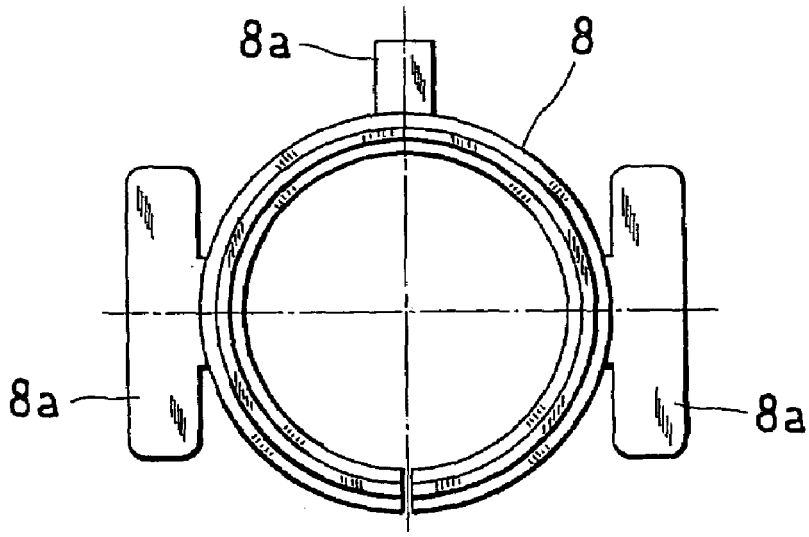
FIG. 9 is a drawing showing a receptacle outer circumference conductor of the board-to-board coaxial connector in which (a) is a plan view, (b) is a half sectional rear view, and (c) is a bottom view.
Figure 9B:
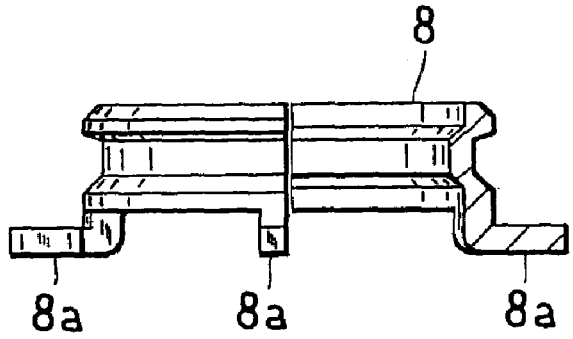
Figure 9C:
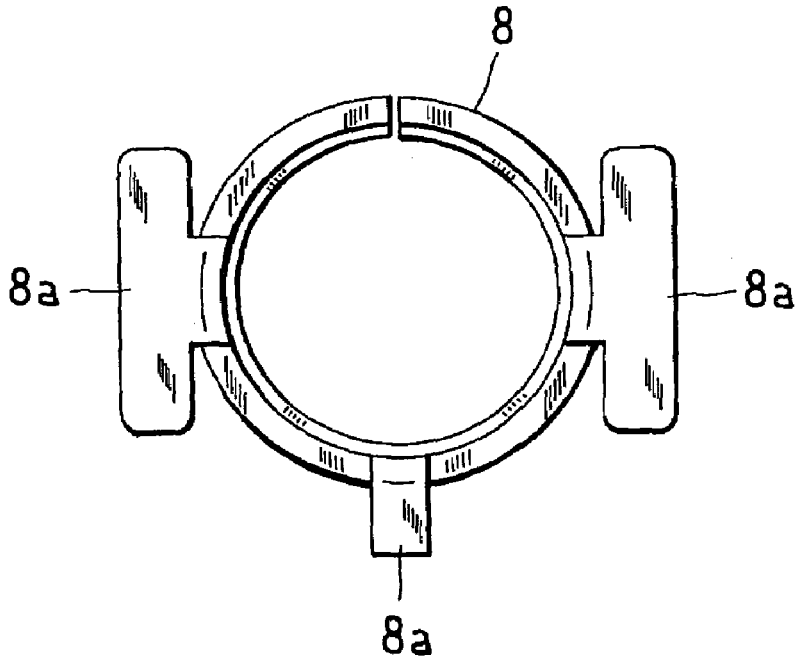
Figure 10:
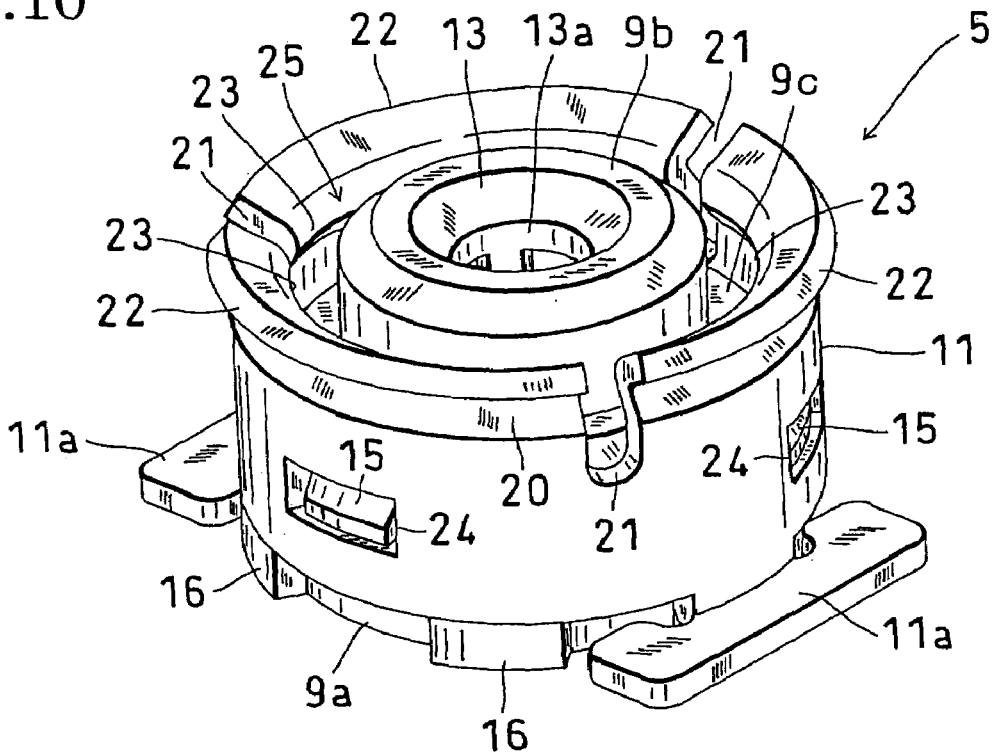
FIG. 10 is an external perspective view of a coaxial connector plug of the board-to-board coaxial connector.

As shown in FIGS. 6 and 7, the receptacle 4 is configured by integrally attaching a receptacle center conductor 7 shown in FIG. 8 and a receptacle outer circumference conductor 8 shown in FIG. 9 to a receptacle body 6 which is insert-molded by an insulating material such as a synthetic resin, and which has a substantially rectangular parallelepiped shape. The receptacle body 6 is formed into a rectangular plate like shape. The receptacle center conductor 7 which is formed into a pin-like shape by deep drawing a thin metal plate that is punched out in a predetermined shape is perpendicularly projected from a substantially middle portion of the upper face of the receptacle body 6. The receptacle outer circumference conductor 8 which is formed into a cylindrical shape by bending a thin metal plate that is punched out in a predetermined shape is perpendicularly projected from the upper face of the receptacle body 6 concentrically with the receptacle center conductor 7. Solder connecting portions 7*a*, 8*a* which extend along the bottom face of the receptacle body 6 are formed integrally with basal end portions of the receptacle center conductor 7 and the receptacle outer circumference conductor 8, respectively. The bottom faces of the solder connecting portions 7*a*, 8*a* are flushly exposed from the bottom face of the receptacle body 6, and the receptacle 4 is formed as a surface mount component.

As shown in FIG. 1, the thus configured receptacle 4 is surface mounted to the one board 2 to be fixed thereto. As result, among the solder connecting portions 7*a*, 8*a* which are exposed from the bottom face of the receptacle body 6, the solder connecting portion 7*a* of the receptacle center conductor 7 is solder connected to a high-frequency signal pattern (not shown) of the board 2 to be electrically connected therewith, and the plural solder connecting portions 8*a* of the receptacle outer circumference conductor 8 are solder connected to a ground pattern (not shown) of the board 2 to be electrically connected therewith.

As shown in FIGS. 10 to 13, the plug 5 is configured by a plug body 9, a plug internal conductor 10, and a plug external conductor 11. As shown in FIG. 14, the plug body 9 is formed into a stepped cylindrical shape, and has a large-diameter lower cylindrical portion 9*a*, a small-diameter upper cylindrical portion 9*b*, and a step face 9*c* between the cylindrical portions. An internal-conductor housing portion 12 which has a substantially rectangular section shape is formed in a center portion of the plug body 9. The internal-conductor housing portion extends from a substantially center portion of the bottom face (the bottom face of the plug body 9) of the lower cylindrical portion 9*a* along the axis of the plug body 9, to a vicinity of the tip end of the upper cylindrical portion 9*b*. A circular insertion hole 13 for allowing the receptacle center conductor 7 to be inserted into the internal-conductor housing portion 12 is opened in a center portion of a tip end face (the tip end face of the plug body 9) of the upper cylindrical portion 9*b*. A groove 14 which elongates perpendicularly from the opening of the internal-conductor housing portion 12 to reach the outer edge is formed in the bottom face of the lower cylindrical portion 9*a*. A pair of right and left projection walls 12*a* are opposingly formed on an upper portion of the side wall of the internal-conductor housing portion 12. The insertion hole 13 is formed as a taper hole in which the hole diameter is gradually reduced as further advancing from the tip end face of the upper cylindrical portion 9*b* toward the insertion direction of the receptacle center conductor 7, and opened in the ceiling face of the internal-conductor housing portion 12 at an opening diameter which is slightly larger than the outer diameter of the receptacle center conductor 7, so that an inverted cone-like wall face of the insertion hole 13 serves as a guiding face 13*a* for insertion of the receptacle center conductor 7. Plural upper engaging projections 15 project at approximately regular intervals in the circumferential direction from an upper outer circumferential face of the lower cylindrical portion 9*a*. Plural lower engaging projections 16 project from a lower end outer circumferential face of the lower cylindrical portion 9*a* at circumferential positions different from those of the upper engaging projections 15.

Figure 15A:
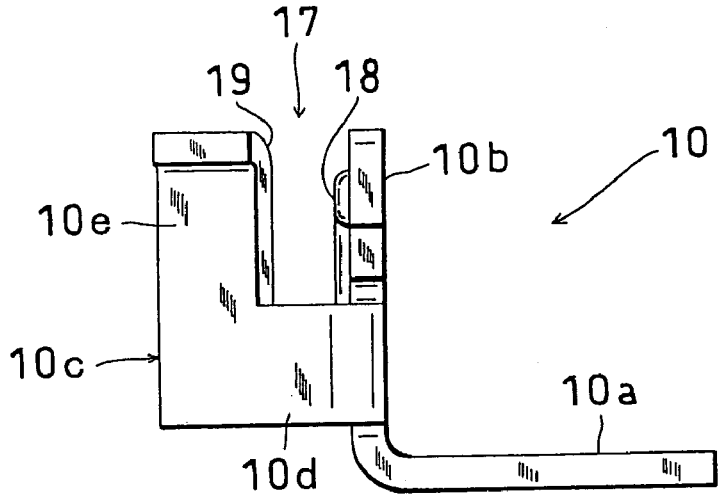
FIG. 15 is a drawing showing a plug internal conductor of the board-to-board coaxial connector in which (a) is a side view, (b) is a plan view, and (c) is a sectional view taken along the line A—A of the plan view.
Figure 15B:
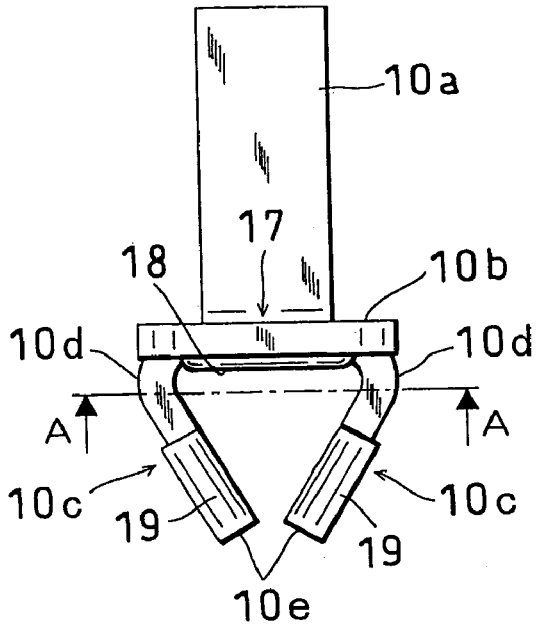
Figure 15C:
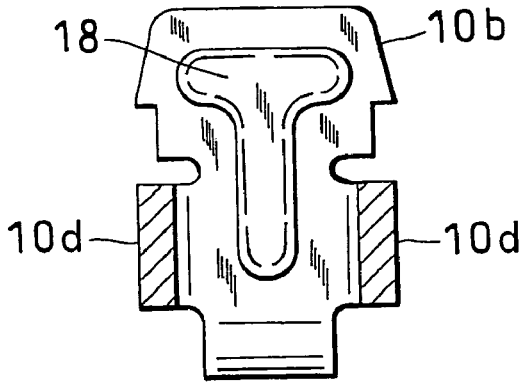
Figure 16A:
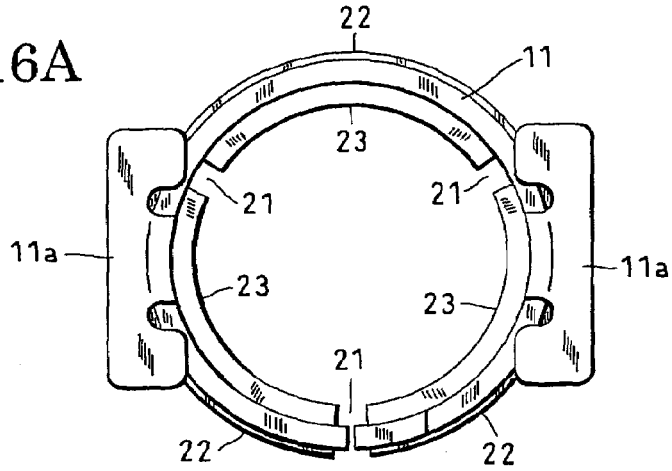
FIG. 16 is a drawing showing a plug external conductor of the board-to-board coaxial connector in which (a) is a bottom view, (b) is a side view, (c) is a plan view, (d) is a sectional view taken along the line A—A of the plan view, and (e) is a sectional view taken along the line B—B of the side view.
Figure 16B:
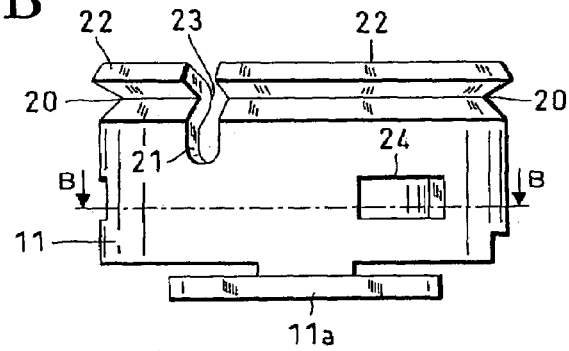
Figure 16E:
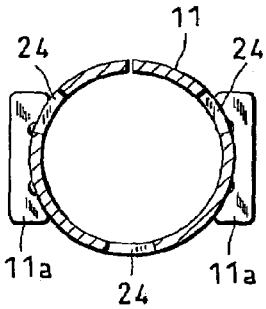
Figure 16C:
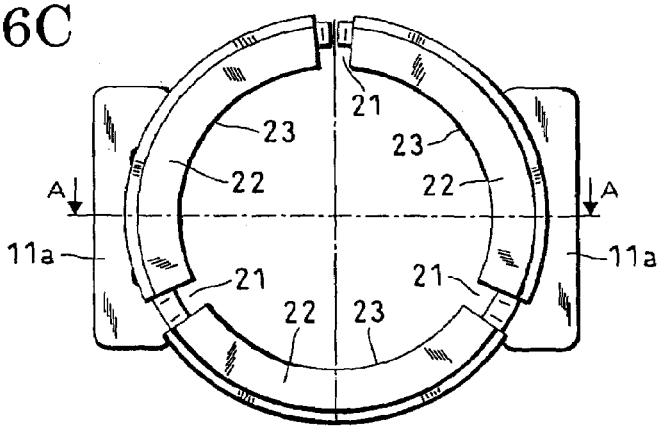
Figure 16D:
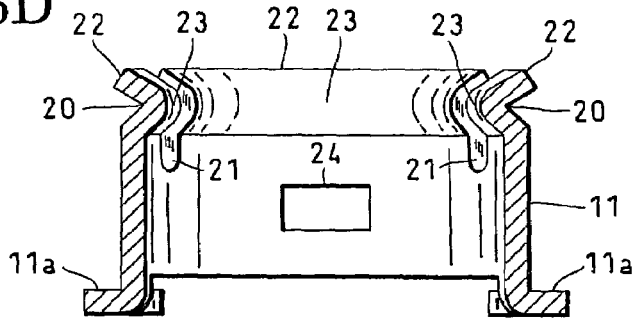

As shown in FIG. 15, the plug internal conductor 10 is formed by bending a thin metal plate that is punched out in a predetermined shape, and has: a solder connecting portion 10*a* which extends along the bottom face of the lower cylindrical portion 9*a*; a stationary contact piece portion 10*b* which is perpendicularly bent from the solder connecting portion 10*a* along the longitudinal direction to extend in the axial direction of the plug body 9; and movable contact piece portions 10*c* which are continuous to the stationary contact piece portion 10*b*, which are juxtaposed in the circumferential direction of the plug body 9, and which extend in the axial direction of the plug body 9. The movable contact piece portions 10*c* are continuous to the stationary contact piece portion 10*b* in a cantilevered state so as to be elastically displaceable in a direction perpendicular to the axial direction of the plug body 9. The stationary contact piece portion 10*b* and movable contact piece portions 10*c* which are juxtaposed in the circumferential direction of the plug body 9 form a contact portion 17 having a multipoint contact structure with respect to the outer circumferential face of the receptacle center conductor 7. More specifically, the movable contact piece portions 10*c* are formed into an L-like shape, and constitute a pair of right and left portions. Each of the movable contact piece portions 10*c* has: a continuous piece 10*d* which is bent in the width direction from one of both side edges or right or left side edge of the stationary contact piece portion 10*b* to extend in a direction perpendicular to the axial direction of the plug body 9; and a contact piece 10*e* which extends from a tip end portion of the continuous piece 10*d* in the axial direction of the plug body 9. The movable contact piece portions 10*c* are placed on the lateral sides of the stationary contact piece portion 10*b*, respectively, and continuous to the stationary contact piece portion 10*b* in a cantilevered state so as to be elastically displaceable in a direction perpendicular to the axial direction of the plug body 9. The stationary contact piece portion 10*b* and contact pieces 10*e* of the movable contact piece portions 10*c* which are juxtaposed in the circumferential direction of the plug body 9 form the contact portion 17 having a multipoint contact structure with respect to the outer circumferential face of the receptacle center conductor 7. The bending angle of each of the continuous pieces 10*d* (the direction in which the respective movable contact piece portions 10*c* are continuous) is set to an acute angle so that the relative distance of the movable contact piece portions 10*c* is gradually reduced as advancing from the basal end portion (the continuous piece 10*d*) toward the tip end portion (the contact piece 10*e*). The contact portion 17 is formed by the one stationary contact piece portion 10*b* and the contact pieces 10*e* of the two movable contact piece portions 10*c*, into a triangular shape as seen in the axial direction of the plug body 9. A T-like contact portion 18 which projects into the contact portion 17 is formed on an upper portion of the stationary contact piece portion 10*b*. The tip end portions of the movable contact piece portions 10*c* are bent in a funnel-like manner to form a guiding face 19 for insertion of the receptacle center conductor 7.

As shown in FIG. 16, the plug external conductor 11 is formed by bending a thin metal plate that is punched out in a predetermined shape, into a cylindrical shape. A pair of right and left solder connecting portions 11*a* which are relatively wide are formed integrally on the cylindrical plug external conductor 11. The solder connecting portions 11*a* downward elongate from two symmetrical positions of the lower end, respectively, and then perpendicularly outward elongate. A reduced-diameter portion 20 is formed in the vicinity of the tip end of the plug external conductor 11, and plural slits 21 are disposed at approximately regular intervals in the circumferential direction in the tip end portion of the plug external conductor 11. The slits 21 form or split the tip end portion of the plug external conductor 11 into plural contact piece portions 22 which is elastically deformable in a radial direction. A contact portion 23 which inward projects, and which is to be in contact with the receptacle outer circumference conductor 8 is formed on the tip end inner face of each of the contact piece portions 22. Engaging holes 24 into which the upper engaging projections 15 of the plug body 9 are to be fitted are opened in the plug external conductor 11 at approximately regular intervals in the circumferential direction.

The stationary contact piece portion 10*b* and movable contact piece portions 10*c* of the plug internal conductor 10 are inserted from the bottom side of the plug body 9 into the internal-conductor housing portion 12 formed in the center portion of the plug body 9, the tip end portion of the stationary contact piece portion 10*b* is pressingly inserted between the pair of right and left projection walls 12*a* formed in the upper portion of the internal-conductor housing portion 12, and the solder connecting portion 10*a* of the plug internal conductor 10 is fitted into the groove 14 formed in the bottom face of the plug body 9, whereby the plug internal conductor 10 is integrally installed to the plug body 9 in a state where the stationary contact piece portion 10*b* extends along the rear side wall of the internal-conductor housing portion 12 and the solder connecting portion 10*a* extends along the bottom face of the plug body 9. As a result, the bottom face of the solder connecting portion 10*a* is exposed flushly from the bottom face of the plug body 9, and the contact portion 17 into which the receptacle center conductor 7 is insertable, and which is to be contacted in multipoint with the outer circumferential face of the receptacle center conductor 7 is formed in the center portion of the plug body 9 by: the stationary contact piece portion 10*b* which is inserted and fixed to the internal-conductor housing portion 12; and the movable contact piece portions 10*c* which are inserted and placed together with the stationary contact piece portion 10*b* in the internal-conductor housing portion 12. The plug external conductor 11 is fitted onto the plug body 9 in a state where the tip end of the plug body 9 butts against the lower end of the plug external conductor 11, whereby the lower end of the plug external conductor 11 is engaged in the fitting direction with the lower engaging projections 16 formed on the lower cylindrical portion 9*a* of the plug body 9, and the upper engaging projections 15 formed on the lower cylindrical portion 9*a* of the plug body 9 are fitted into the engaging holes 24 of the plug external conductor 11. Therefore, the plug external conductor 11 is installed integrally to the plug body 9 while the movements in the fitting direction (the axial direction of the plug body 9) and circumferential direction of the plug external conductor 11 with respect to the plug body 9 are restricted. As a result, the solder connecting portions 11*a* formed in the lower end of the plug external conductor 11 are led out to the outside of the bottom face of the plug body 9 along the bottom face, and the bottom face of the plug body 9 is flush with the bottom faces of the solder connecting portions 11*a*. The plug external conductor 11 is fitted and fixed onto the plug body 9 in a state where the lower inner circumferential face of the conductor is in close contact with the lower cylindrical portion 9*a* of the plug body 9. The contact piece portions 22 formed in the tip end portion of the plug external conductor 11 are concentrically arranged on the outer circumference of the upper cylindrical portion 9*b* of the plug body 9. An annular groove 25 which is bottomed by the step face 9*c* of the plug body 9, and into which the receptacle outer circumference conductor B is to be fitted is formed between the upper cylindrical portion 9*b* and the contact piece portions 22. The plug 5 which can be mutually fitted to and separated from the receptacle 4 as shown in FIGS. 1 to 5 and 10 to 13 can be assembled, and the plug 5 is formed as a surface mount component.

Figure 11:
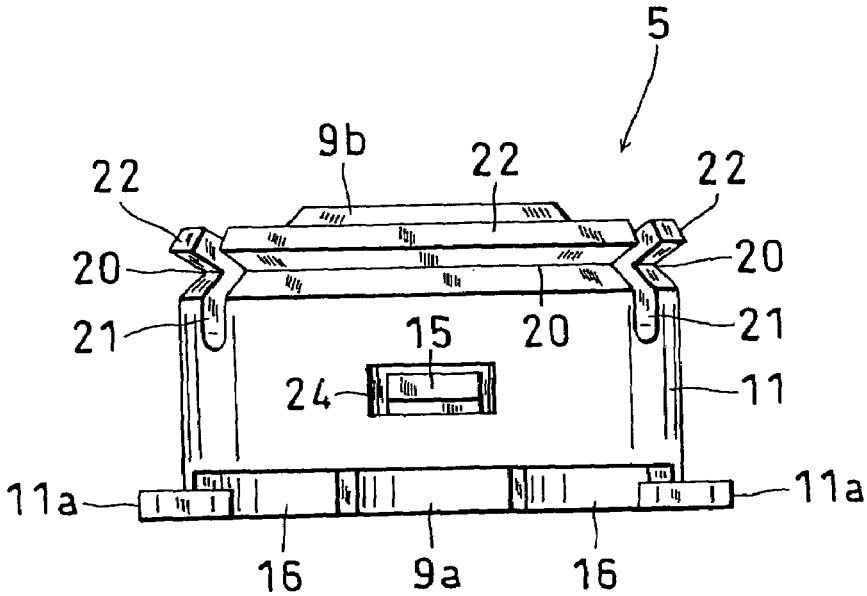
FIG. 11 is a front view of the coaxial connector plug of the board-to-board coaxial connector.
Figure 12:
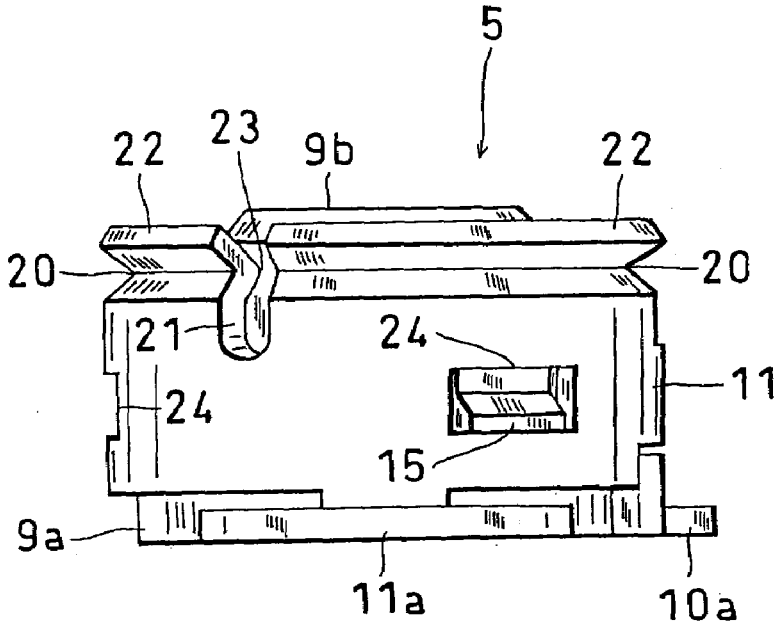
FIG. 12 is a side view of the coaxial connector plug of the board-to-board coaxial connector.
Figure 13:
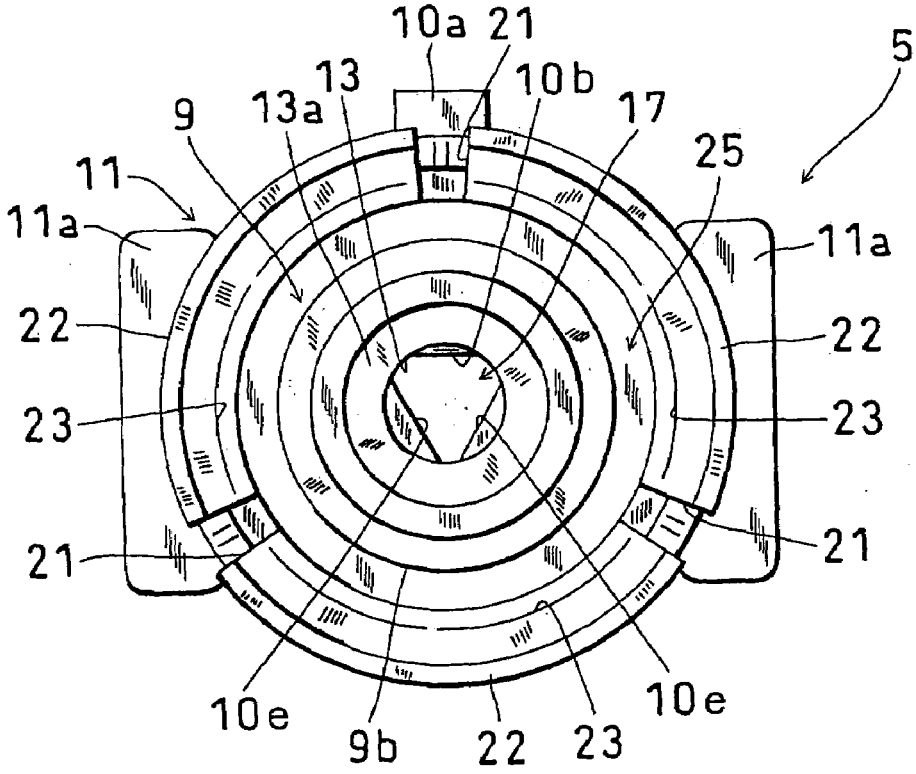
FIG. 13 is a plan view of the coaxial connector plug of the board-to-board coaxial connector.
Figure 14A:
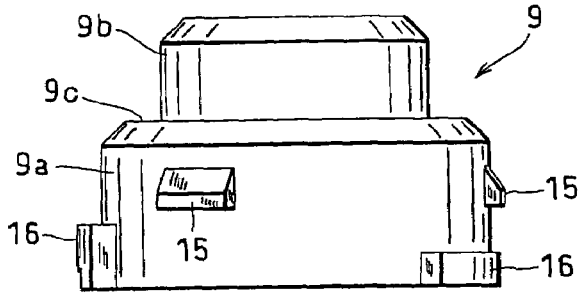
FIG. 14 is a drawing showing a plug body of the board-to-board coaxial connector in which (a) is a side view, (b) is a bottom view, (c) is a sectional view taken along the line A—A of the bottom view, and (d) is a rear view.
Figure 14B:
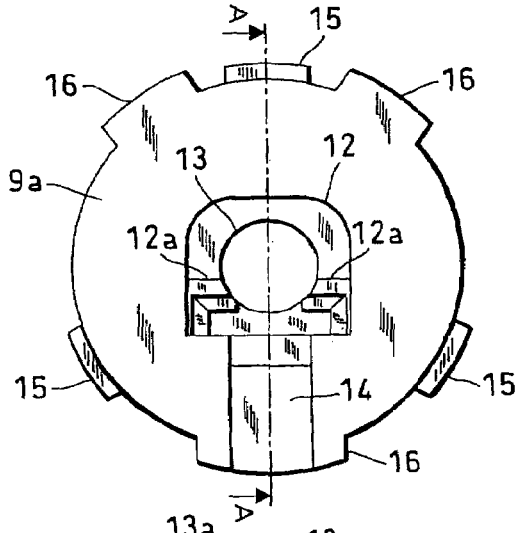
Figure 14C:
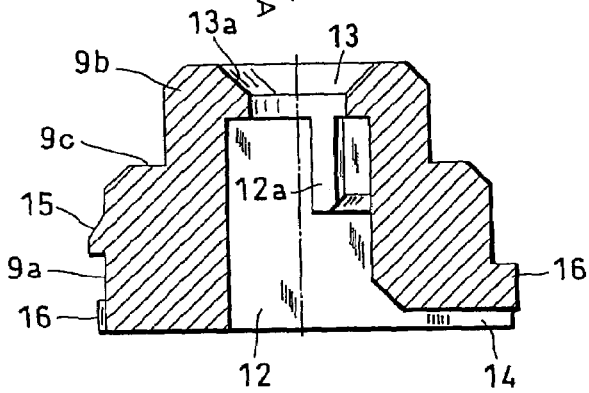
Figure 14D:
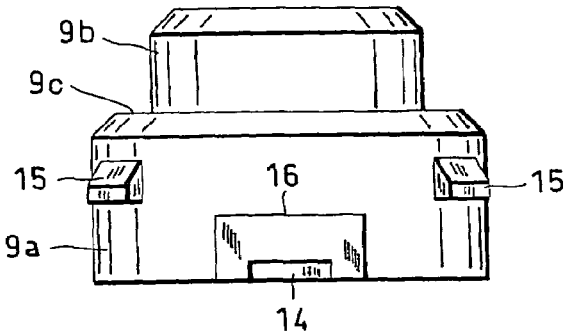

As shown in FIGS. 11 and 12, in the plug 5 of the assembled state, the tip end of the plug body 9 (the tip end of the upper cylindrical portion 9*b*) is projected from the tip end of the plug external conductor 11 in the fitting direction of the receptacle 4.

As shown in FIG. 1, the thus configured plug 5 is surface mounted and fixed to the other board 3, whereby, among the solder connecting portion 10*a* exposed from the bottom face of the plug body 9 and the solder connecting portions 11*a* which are flush therewith, the solder connecting portion 10*a* of the plug internal conductor 10 is solder connected to a high-frequency signal pattern (not shown) of the board 3 to be electrically connected therewith, and the plural solder connecting portions 11*a* of the plug external conductor 11 are solder connected to a ground pattern (not shown) of the board 3 to be electrically connected therewith.

As shown in FIGS. 1 to 5, in the coaxial connector 1 of the embodiment, the receptacle 4 which is surface mounted on the one board 2, and the plug 5 which is surface mounted on the other board 3 are fitted with each other, whereby the receptacle center conductor 7 is inserted from the insertion hole 13 of the plug body 9 into the contact portion 17 of the plug internal conductor 10 which is formed in the internal-conductor housing portion 12. This causes the movable contact piece portions 10*c* of the contact portion 17 to be elastically displaced (the position indicated by the solid line in FIG. 4) against the spring force of itself in a direction perpendicular to the axial direction of the plug body 9 from the initial position (the position in a free state where the receptacle 4 and the plug 5 are separated from each other, and the receptacle center conductor 7 is not inserted) indicated by the phantom line in FIG. 4 to be elastically contacted with the outer circumferential face of the receptacle center conductor 7. The receptacle center conductor 7 is pressed by the movable contact piece portions 10*c* against the stationary contact piece portion 10*b* of the contact portion 17, the contact portion 18 is contacted with the outer circumferential face of the receptacle center conductor 7, and the contact portion 17 of the plug internal conductor 10 is contacted with the outer circumferential face of the receptacle center conductor 7 in a direction perpendicular to the axial direction of the plug body 9. In this way, the receptacle center conductor 7 and the plug internal conductor 10 are in contact with each other in the three points to be electrically connected therewith. At the same time, the receptacle outer circumference conductor 8 is fitted into the annular groove 25 formed in the tip end portion of the plug 5. This causes the contact piece portions 22 of the plug external conductor 11 to be elastically displaced outward in a radial direction of the plug body 9 against their spring force from the initial position, and the contact portions 23 which are formed on the inner faces of the tip end portions of the contact piece portions 22 to inward project are elastically contacted with the outer circumferential face of the receptacle outer circumference conductor 8, thereby electrically connecting the receptacle outer circumference conductor 8 and the plug external conductor 11 with each other. The fitting contact between the receptacle outer circumference conductor 8 and the plug external conductor 11 causes the ground patterns of the two boards 2, 3 to be electrically connected with each other, and the contact between the receptacle center conductor 7 and the plug internal conductor 10 causes the high-frequency signal patterns of the two boards 2, 3 to be electrically connected with each other. As a result, the signal line required for a high-frequency signal, and the shield line covering the outer circumference of the line are formed in a substantially coaxial manner, and the coaxial connector 1 exerts a function of transmitting a high-frequency signal between the two boards 2, 3 which are placed in substantially parallel.

An axis in which the axis of the pin-like receptacle center conductor 7 coincides with that of the stepped cylindrical plug body 9 is the axis of the coaxial connector 1.

As described above, the coaxial connector 1 of the embodiment is formed by one coaxial connector pair consisting of: the receptacle 4 which is to be surface mounted to the one board 2; and the plug 5 which is to be surface mounted to the other board 3, and configured so that the contact portion 17 is formed in the internal conductor housing portion 12 of the insulative plug body 9 into which the pin-like receptacle center conductor 7 is to be inserted, the contact portion has: the stationary contact piece portion 10*b* which is perpendicularly bent from the solder connecting portion 10*a* of the plug internal conductor 10 to extend in the axial direction of the connector; and the movable contact piece portions 10*c* which are continuous to the stationary contact piece portion 10*b*, which are juxtaposed in a circumferential direction of the connector, and which extend in the axial direction of the connector, and, when the receptacle center conductor 7 is inserted into the internal conductor housing portion 12, the movable contact piece portions 10*c* are elastically displaced in a direction perpendicular to the axial direction of the connector to be elastically contacted with the outer circumferential face of the receptacle center conductor 7, together with the stationary contact piece portion 10*b*. The fitting contact between the receptacle outer circumference conductor 8 and the plug external conductor 11 causes the ground patterns of the boards 2, 3 to be electrically connected with each other, and the contact between the receptacle center conductor 7 and the plug internal conductor 10 causes the signal patterns of the boards 2, 3 to be electrically connected with each other. As a result, the signal line required for transmitting a high-frequency signal or the like between the two boards, and the shield line covering the outer circumference of the line are formed in a substantially coaxial manner, and transmission of a high-frequency signal or the like between the two boards 2, 3 is realized. In the contact portion 17 of the plug internal conductor 10, the movable contact piece portions 10*c* are elastically displaced in a direction perpendicular to the axial direction of the connector (the axial direction of the pin-like receptacle center conductor 7) to be elastically contacted with the outer circumferential face of the receptacle center conductor 7, together with the stationary contact piece portion, i.e., the receptacle center conductor 7 is in multipoint contact with the plug internal conductor 10 in a direction perpendicular to the axial direction of the connector. Therefore, the allowable ranges with respect to the difference in the insertion stroke of the receptacle center conductor 7 due to variation of the relative distance between the two boards 2, 3, and dispersion of fitting heights of the coaxial connector pair can be increased. Furthermore, also the allowable range with respect to the axis deviation (offcenter) of the receptacle 4 and the plug 5 caused by dispersion of relative positions of the two board 2, 3 in the direction along the board face can be increased. Moreover, within the allowable ranges, instantaneous disconnection due to vibrations, an impact of dropping, or the like hardly occurs, and such dispersions can be allowed without lowering the contact reliability of the receptacle center conductor 7 and the plug internal conductor 10.

In the coaxial connector 1, each of the movable contact piece portions 10*c* is formed into an L-like shape by: the continuous piece 10*d* which is bent at an acute angle from corresponding one of both side edges of the stationary contact piece portion 10*b* to extend in a direction perpendicular to the axial direction of the connector; and the contact piece 10*e* which extends from the continuous piece 10*d* in the axial direction of the connector, and the contact portion 17 is formed by the stationary contact piece portion 10*b* and the movable contact piece portions 10*c* into a triangular shape as seen in the axial direction of the connector. Therefore, the receptacle center conductor 7 can be surrounded in a balanced manner by the three contact pieces 10*d*, 10*e* of the plug internal conductor contact portion 17, and the contact pieces 10*d*, 10*e* can be stably contacted. Consequently, the contact reliability of the receptacle center conductor 7 and the plug internal conductor 10 can be enhanced.

In the coaxial connector 1, the cylindrical contact portion of the plug external conductor 11 which is to be in contact with the receptacle outer circumference conductor 8 is provided with the plural slits 21 to be split into the plural contact piece portions 22 which are elastically displaceable in a radial direction of the connector, and the contact portion 23 with respect to the receptacle outer circumference conductor 8 is formed on the inner face of the tip end side of each of the contact piece portions 22, the contact portion protruding inwardly. The contact portions 23 which are to be in contact with the receptacle outer circumference conductor 8 are formed on the inner face of the plug external conductor 11. Therefore, the outer diameter of the receptacle outer circumference conductor 8 can be reduced, so that the whole receptacle 4 can be miniaturized.

In the coaxial connector 1, the tip end of the plug body 9 protrudes from the tip end of the plug external conductor 11. When the axis deviation is within the guidance of the guiding face 13*a* of the insertion hole 13, the receptacle 4 and the plug 5 can be fitted with each other while the receptacle center conductor 7 is guided to the center. By contrast, when the axis deviation exceeds the guidance of the guiding face 13*a* of the insertion hole 13, the tip end of the plug body 9 protruding from the tip end of the plug external conductor 11 interferes with the receptacle center conductor 7 or the receptacle outer circumference conductor 8, and hence there is no possibility that the contact piece portions 22 of the plug external conductor 11 are bent or deformed. The spring function of each of the contact piece portions 22 can be prevented from degrading or disappearing, and an excellent contact reliability of the receptacle outer circumference conductor 8 with respect to the plug external conductor 11 can be obtained.

Therefore, transmission of a high-frequency signal or the like between the two boards 2, 3 which are placed in substantially parallel to each other is realized by the one coaxial connector pair (the coaxial connectors 1) of the receptacle 4 and the plug 5 which are fittable with each other, without using a jumper cable. Furthermore, the receptacle center conductor 7 is in multipoint contact with the contact portion 17 of the plug internal conductor 10 which is a counter connecting portion, in a direction perpendicular to the axial direction of the connector. Therefore, it is possible to provide the coaxial connector 1 in which the allowable range for dispersions of the relative distance of the two boards 2, 3, and of the relative position along the board faces is made large, the relative distance and position are tolerated so that instantaneous disconnection due to vibrations, an impact of dropping, or the like does not occur, and the contact reliability of the receptacle center conductor 7 and the plug internal conductor 10 is excellent.

Figure 17A:
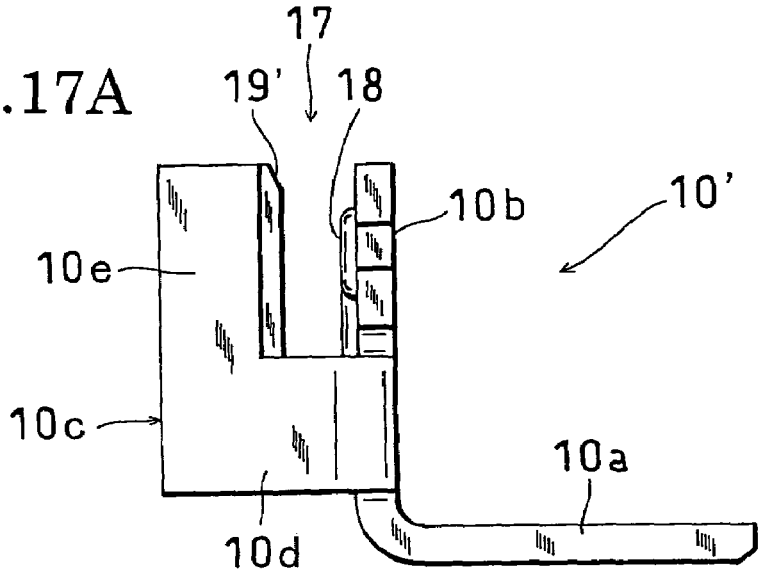
FIG. 17 is a drawing showing a modified structure of the plug internal conductor in which (a) is a side view, (b) is a plan view, and (c) is a partial enlarged sectional view of a tip-end guiding face portion.
Figure 17B:
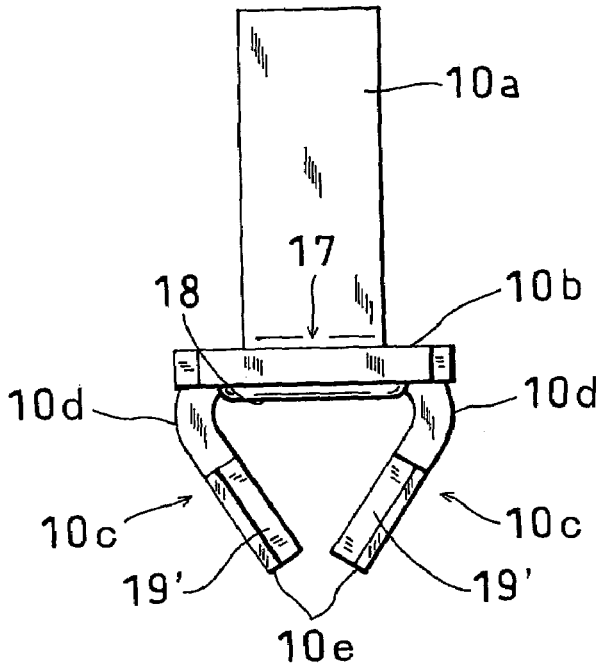
Figure 17C:
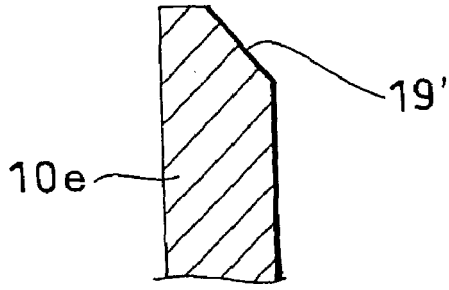

FIG. 17 shows a modified structure of the plug internal conductor. The plug internal conductor 10 shown in FIG. 15 is configured so that the tip end portions of the movable contact piece portions 10*c* are bent in a funnel-like manner to form the guiding face 19 for insertion of the receptacle center conductor 7, in the tip end portions of the movable contact piece portions 10*c*. By contrast, in a plug internal conductor 10' shown in FIG. 17, inner edges of tip end portions of the movable contact piece portions 10*c* are chamfered to form a guiding face 19' for insertion of the receptacle center conductor 7 in the tip end portions of the movable contact piece portions 10*c*. The guiding face is configured by a C plane. In the case of the guiding face 19 of the plug internal conductor 10 shown in FIG. 15, the protruding basal end portions of the movable contact piece portions 10*c* are outward pressed by the tip end portion of the receptacle center conductor 7 in a state where the outward protruding tip end portions of the movable contact piece portions 10*c* are caused by prying when the receptacle center conductor 7 is inserted to interfere with the side wall of the internal-conductor housing portion 12 of the plug body 9, and hence there is a possibility that the movable contact piece portions 10*c* are plastically deformed. By contrast, in the case of the guiding face 19' of the plug internal conductor 10' shown in FIG. 17, the tip end portions of the movable contact piece portions 10*c* do not outward project, and the movable contact piece portions 10*c* can be formed into a flat plate like shape over a range from the basal end to the tip end. Even when prying occurs during insertion of the receptacle center conductor 7, therefore, the whole movable contact piece portions 10*c* are caused to escape to the outside (elastically displaced) without twisting the movable contact piece portions 10*c*. Consequently, the movable contact piece portions 10*c* can be prevented from being plastically deformed by prying when the receptacle center conductor 7 is inserted.

The plug internal conductor 10' shown in FIG. 17 is identical with the plug internal conductor 10 shown in FIG. 15 in function and structure other than the guiding face 19'. Therefore, the identical components are denoted by the same reference numerals, and their detailed description is omitted.

Figure 18:
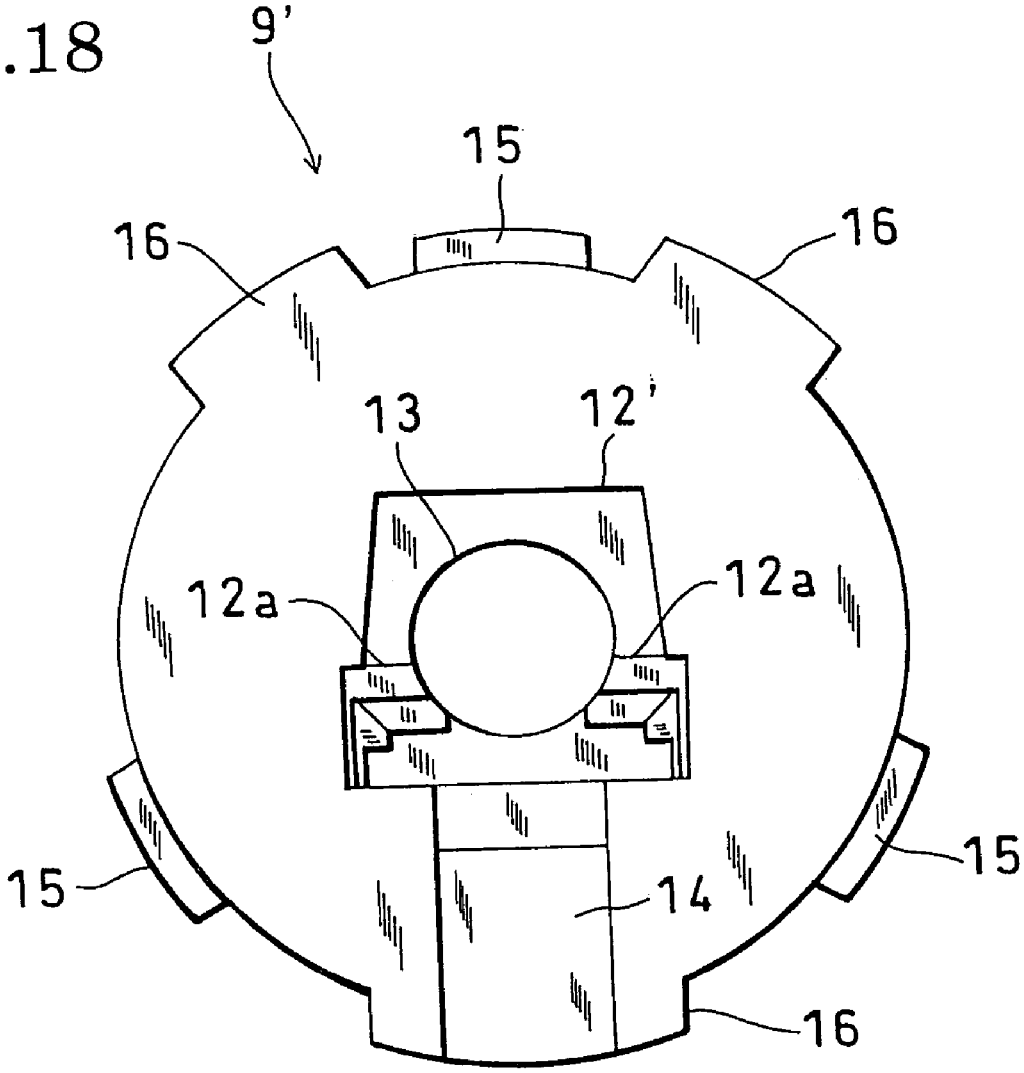
FIG. 18 is a drawing showing a modified structure of the plug body.
Figure 19:
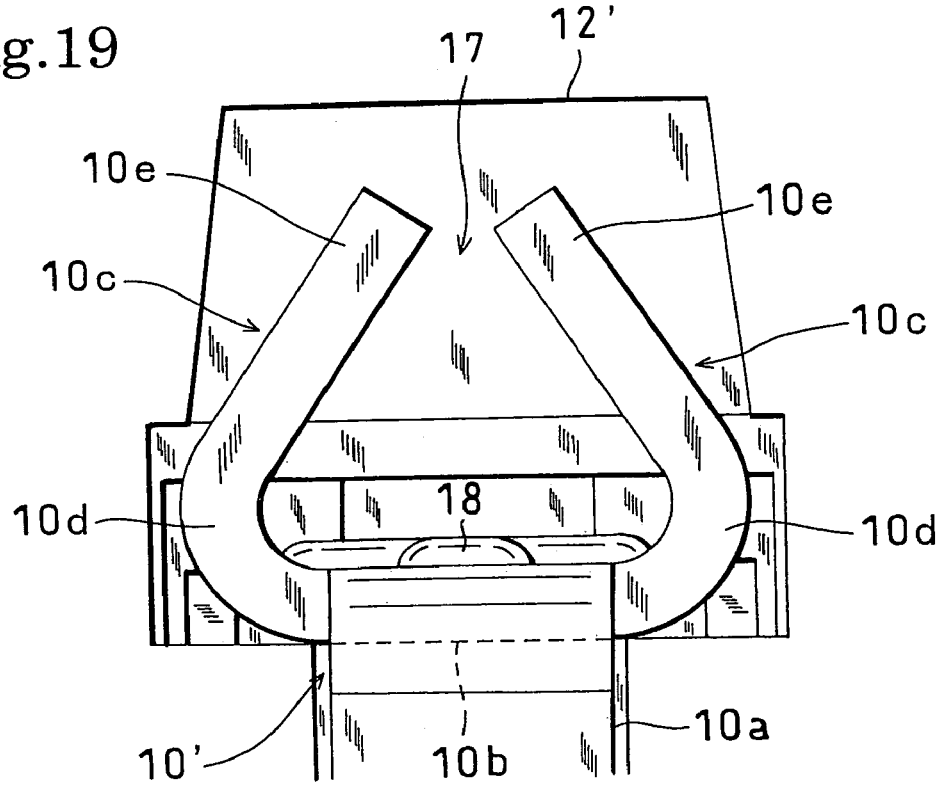
FIG. 19 is an enlarged bottom view of an internal-conductor housing portion in a state where the plug internal conductor of FIG. 17 is installed to the plug body of FIG. 18.
Figure 20:
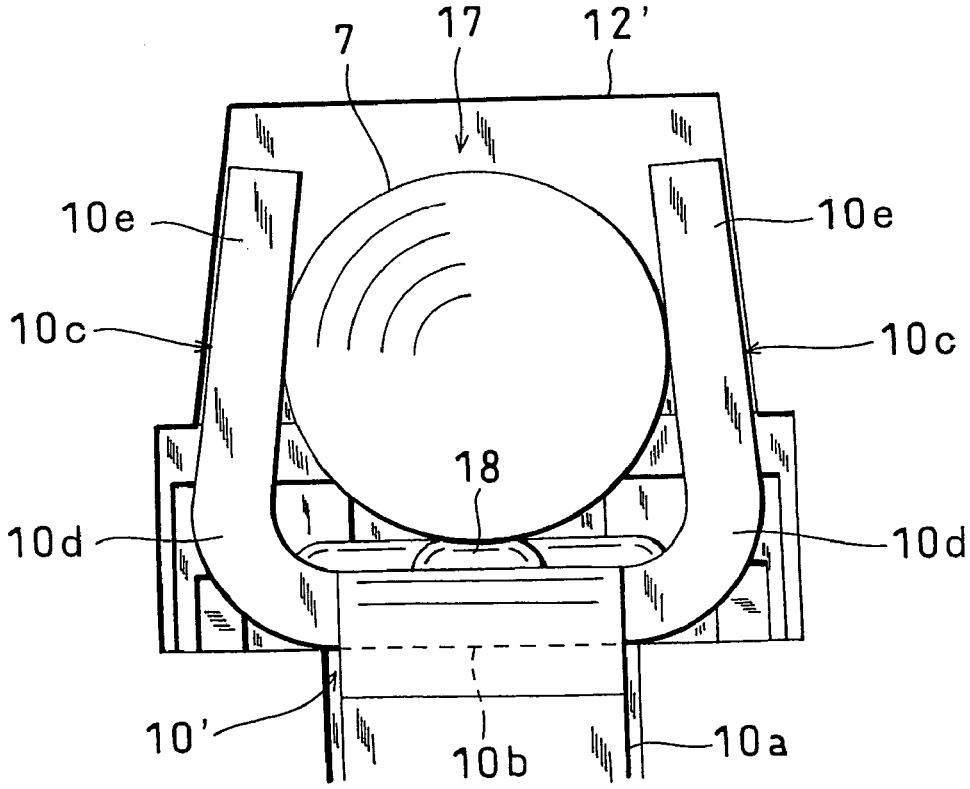
FIG. 20 is an enlarged bottom view of the internal-conductor housing portion in a state where the receptacle center conductor in FIG. 19 is inserted.

FIG. 18 shows a modified structure of the plug body. In the plug body 9 shown in FIG. 14, the internal-conductor housing portion 12 having a substantially square section shape is formed, and the side walls (the right and left side walls) are adjacent to the side wall (the rear side wall) of the internal-conductor housing portion 12 along which the stationary contact piece portion 10*b* of the plug internal conductor 10 extends. By contrast, in the plug body 9' shown in FIG. 18, an internal-conductor housing portion 12' having a substantially trapezoidal section shape is formed in order to attain the following function. When the receptacle center conductor 7 is inserted, the movable contact piece portions 10*c* are opened in a truncated V-shaped manner as seen from the axial direction of the connector, and the movable contact piece portions 10*c* press the receptacle center conductor 7 against the stationary contact piece portion 10*b*. Therefore, the outer shape of the contact portion 17 after elastic displacement when the receptacle center conductor 7 is inserted becomes substantially trapezoidal as seen from the axial direction of the connector, and the outer shape is approximately identical with the shape of the internal-conductor housing portion 12'. The side walls (the right and left side walls) adjacent to the side wall (the rear side wall) of the internal-conductor housing portion 12' extend along the movable contact piece portions 10*c* after elastic displacement when the receptacle center conductor 7 is inserted. When the plug internal conductor 10' shown in FIG. 17 is integrally installed to the plug body 9' as shown in FIG. 19, the side walls (the right and left side walls) which are adjacent to the side wall (the rear side wall) of the internal-conductor housing portion 12' which elongate along the movable contact piece portions 10*c*, and which form a truncated V-shape as seen from the axial direction of the connector exist outside the movable contact piece portions 10*c* after elastic displacement when the receptacle center conductor 7 is inserted, as shown in FIG. 20. Even when prying occurs during insertion of the receptacle center conductor 7, therefore, the whole movable contact piece portions 10*c* are caused to escape to the outside (elastically displaced) without twisting the movable contact piece portions 10*c*, and the whole faces of the movable contact piece portions 10*c* are received by the side walls (the right and left side walls) of the internal-conductor housing portion 12' which exist outside the movable contact piece portions. Consequently, the movable contact piece portions 10*c* can be prevented more surely from being plastically deformed by prying when the receptacle center conductor 7 is inserted.

The plug body 9' shown in FIG. 19 is identical with the plug body 9' shown in FIG. 14 in function and structure other than the internal-conductor housing portion 12'. Therefore, the identical components are denoted by the same reference numerals, and their detailed description is omitted.

What is claimed is:

1. A board-to-board coaxial connector which is configured by one coaxial connector pair comprising:

a coaxial connector receptacle which is to be surface mounted to one printed circuit board; and a coaxial connector plug which is to be surface mounted to another printed circuit board, said coaxial connector receptacle and said coaxial connector plug being fittable with each other, wherein:

a contact portion is formed in an internal conductor housing portion of an insulative plug body into which a pin-like receptacle center conductor is to be inserted, said contact portion has: a stationary contact piece portion which is perpendicularly bent from a solder connecting portion of a plug internal conductor to extend in an axial direction of said connector;

movable contact piece portions which are continuous to said stationary contact piece portion, which are juxtaposed in a circumferential direction of said connector, and which extend in the axial direction of said connector, and, when said receptacle center conductor is inserted into said internal conductor housing portion, said movable contact piece portions are elastically displaced in a direction perpendicular to the axial direction of said connector to be elastically contacted with an outer circumferential face of said receptacle center conductor, together with said stationary contact piece portion;

a cylindrical contact portion of a plug external conductor which is to be in contact with a receptacle outer circumference conductor is provided with a plurality of slits to be split into plural contact piece portions which are elastically displaceable in a radial direction of said connector; and said contact portion with respect to the receptacle outer circumference conductor is formed on an inner face of a tip end side of each of said contact piece portions, said contact portion protruding inwardly.

2. A board-to-board coaxial connector which is configured by one coaxial connector pair comprising:

a coaxial connector receptacle which is to be surface mounted to one printed circuit board; and a coaxial connector plug which is to be surface mounted to another printed circuit board, said coaxial connector receptacle and said coaxial connector plug being fittable with each other, wherein:

a contact portion is formed in an internal conductor housing portion of an insulative plug body into which a pin-like receptacle center conductor is to be inserted, said contact portion has: a stationary contact piece portion which is perpendicularly bent from a solder connecting portion of a plug internal conductor to extend in an axial direction of said connector;

movable contact piece portions which are continuous to said stationary contact piece portion, which are juxtaposed in a circumferential direction of said connector, and which extend in the axial direction of said connector, and, when said receptacle center conductor is inserted into said internal conductor housing portion, said movable contact piece portions are elastically displaced in a direction perpendicular to the axial direction of said connector to be elastically contacted with an outer circumferential face of said receptacle center conductor, together with said stationary contact piece portion;

each of said movable contact piece portions is formed into an L-like shape by: a continuous piece which is bent at an acute angle from corresponding one of both side edges of said stationary contact piece portion to extend in a direction perpendicular to the axial direction of said connector;

a contact piece which extends from said continuous piece in the axial direction of said connector, said contact portion is formed by said stationary contact piece portion and said mov-able contact piece portions into a triangular shape as seen in the axial direction of said connector, a cylindrical contact portion of a plug external conductor which is to be in contact with a receptacle outer circumference conductor is provided with a plurality of slits to be split into plural contact piece portions which are elastically displaceable in a radial direction of said connector; and said contact portion with respect to the receptacle outer circumference conductor is formed on an inner face of a tip end side of each of said contact piece portions, said contact portion protruding inwardly.

3. A board-to-board coaxial connector which is configured by one coaxial connector pair comprising:

a coaxial connector receptacle which is to be surface mounted to one printed circuit board; and a coaxial connector plug which is to be surface mounted to another printed circuit board, said coaxial connector receptacle and said coaxial connector plug being fittable with each other, wherein:

a contact portion is formed in an internal conductor housing portion of an insulative plug body into which a pin-like receptacle center conductor is to be inserted, said contact portion has: a stationary contact piece portion which is perpendicularly bent from a solder connecting portion of a plug internal conductor to extend in an axial direction of said connector;

movable contact piece portions which are continuous to said stationary contact piece portion, which are juxtaposed in a circumferential direction of said connector, and which extend in the axial direction of said connector, and, when said receptacle center conductor is inserted into said internal conductor housing portion, said movable contact piece portions are elastically displaced in a direction perpendicular to the axial direction of said connector to be elastically contacted with an outer circumferential face of said receptacle center conductor, together with said stationary contact piece portion;

each of said movable contact piece portions is formed into an L-like shape by: a continuous piece which is bent at an acute angle from corresponding one of both side edges of said stationary contact piece portion to extend in a direction perpendicular to the axial direction of said connector;

a contact piece which extends from said continuous piece in the axial direction of said connector, said contact portion is formed by said stationary contact piece portion and said movable contact piece portions into a triangular shape as seen in the axial direction of said connector;

an inner edge of a tip end portion of each of said movable contact piece portions is chamfered to form a guiding face for insertion of said receptacle center conductor in the tip end portion of the movable contact piece portion; a cylindrical contact portion of a plug external conductor which is to be in contact with a receptacle outer circumference conductor is provided with a plurality of slits to be split into plural contact piece portions which are elastically displaceable in a radial direction of said connector; and said contact portion with respect to the receptacle outer circumference conductor is formed on an inner face of a tip end side of each of said contact piece portions, said contact portion protruding inwardly.

4. A board-to-board coaxial connector which is configured by one coaxial connector pair comprising:

a coaxial connector receptacle which is to be surface mounted to one printed circuit board; and a coaxial connector plug which is to be surface mounted to another printed circuit board, said coaxial connector receptacle and said coaxial connector plug being fittable with each other, wherein:

a contact portion is formed in an internal conductor housing portion of an insulative plug body into which a pin-like receptacle center conductor is to be inserted, said contact portion has: a stationary contact piece portion which is perpendicularly bent from a solder connecting portion of a plug internal conductor to extend in an axial direction of said connector;

movable contact piece portions which are continuous to said stationary contact piece portion, which are juxtaposed in a circumferential direction of said connector, and which extend in the axial direction of said connector, and, when said receptacle center conductor is inserted into said internal conductor housing portion, said movable contact piece portions are elastically displaced in a direction perpendicular to the axial direction of said connector to be elastically contacted with an outer circumferential face of said receptacle center conductor, together with said stationary contact piece portion;

each of said movable contact piece portions is formed into an L-like shape by: a continuous piece which is bent at an acute angle from corresponding one of both side edges of said stationary contact piece portion to extend in a direction perpendicular to the axial direction of said connector;

a contact piece which extends from said continuous piece in the axial direction of said connector, said contact portion is formed by said stationary contact piece portion and said movable contact piece portions into a triangular shape as seen in the axial direction of said connector;

a shape of said internal conductor housing portion is substantially identical with an outer shape of said contact portion after elastic displacement when said receptacle center conductor is inserted, a cylindrical contact portion of a plug external conductor which is to be in contact with a receptacle outer circumference conductor is provided with a plurality of slits to be split into plural contact piece portions which are elastically displaceable in a radial direction of said connector; and said contact portion with respect to the receptacle outer circumference conductor is formed on an inner face of a tip end side of each of said contact piece portions, said contact portion protruding inwardly.

5. A board-to-board coaxial connector which is configured by one coaxial connector pair comprising:

a coaxial connector receptacle which is to be surface mounted to one printed circuit board; and a coaxial connector plug which is to be surface mounted to another printed circuit board, said coaxial connector receptacle and said coaxial connector plug being fittable with each other, wherein:

a contact portion is formed in an internal conductor housing portion of an insulative plug body into which a pin-like receptacle center conductor is to be inserted, said contact portion has: a stationary contact piece portion which is perpendicularly bent from a solder connecting portion of a plug internal conductor to extend in an axial direction of said connector;

movable contact piece portions which are continuous to said stationary contact piece portion, which are juxtaposed in a circumferential direction of said connector, and which extend in the axial direction of said connector, and, when said receptacle center conductor is inserted into said internal conductor housing portion, said movable contact piece portions are elastically displaced in a direction perpendicular to the axial direction of said connector to be elastically contacted with an outer circumferential face of said receptacle center conductor, together with said stationary contact piece portion;

each of said movable contact piece portions is formed into an L-like shape by: a continuous piece which is bent at an acute angle from corresponding one of both side edges of said stationary contact piece portion to extend in a direction perpendicular to the axial direction of said connector;

a contact piece which extends from said continuous piece in the axial direction of said connector, said contact portion is formed by said stationary contact piece portion and said movable contact piece portions into a triangular shape as seen in the axial direction of said connector;

an inner edge of a tip end portion of each of said movable contact piece portions is chamfered to form a guiding face for insertion of said receptacle center conductor in the tip end portion of the movable contact piece portion, a shape of said internal conductor housing portion is substantially identical with an outer shape of said contact portion after elastic displacement when said receptacle center conductor is inserted:

a cylindrical contact portion of a plug external conductor which is to be in contact with a receptacle outer circumference conductor is provided with a plurality of slits to be split into plural contact piece portions which are elastically displaceable in a radial direction of said connector; and said contact portion with respect to the receptacle outer circumference conductor is formed on an inner face of a tip end side of each of said contact piece portions, said contact portion protruding inwardly.

6. A board-to-board coaxial connector which is configured by one coaxial connector pair comprising:

a coaxial connector receptacle which is to be surface mounted to one printed circuit board; and a coaxial connector plug which is to be surface mounted to another printed circuit board, said coaxial connector receptacle and said coaxial connector plug being fittable with each other, wherein:

a contact portion is formed in an internal conductor housing portion of an insulative plug body into which a pin-like receptacle center conductor is to be inserted, said contact portion has: a stationary contact piece portion which is perpendicularly bent from a solder connecting portion of a plug internal conductor to extend in an axial direction of said connector;

movable contact piece portions which are continuous to said stationary contact piece portion, which are juxtaposed in a circumferential direction of said connector, and which extend in the axial direction of said connector, and, when said receptacle center conductor is inserted into said internal conductor housing portion, said movable contact piece portions are elastically displaced in a direction perpendicular to the axial direction of said connector to be elastically contacted with an outer circumferential face of said receptacle center conductor, together with said stationary contact piece portion;

a cylindrical contact portion of a plug external conductor which is to be in contact with a receptacle outer circumference conductor is provided with a plurality of slits to be split into plural contact piece portions which are elastically displaceable in a radial direction of said connector, said contact portion with respect to the receptacle outer circumference conductor is formed on an inner face of a tip end side of each of said contact piece portions, said contact portion protruding inwardly; and a tip end of said plug body protrudes from a tip end of said plug external conductor.

7. A board-to-board coaxial connector which is configured by one coaxial connector pair comprising:

a coaxial connector receptacle which is to be surface mounted to one printed circuit board; and a coaxial connector plug which is to be surface mounted to another printed circuit board, said coaxial connector receptacle and said coaxial connector plug being fittable with each other, wherein:

a contact portion is formed in an internal conductor housing portion of an insulative plug body into which a pin-like receptacle center conductor is to be inserted, said contact portion has: a stationary contact piece portion which is perpendicularly bent from a solder connecting portion of a plug internal conductor to extend in an axial direction of said connector;

movable contact piece portions which are continuous to said stationary contact piece portion, which are juxtaposed in a circumferential direction of said connector, and which extend in the axial direction of said connector, and, when said receptacle center conductor is inserted into said internal conductor housing portion, said movable contact piece portions are elastically displaced in a direction perpendicular to the axial direction of said connector to be elastically contacted with an outer circumferential face of said receptacle center conductor, together with said stationary contact piece portion;

each of said movable contact piece portions is formed into an L-like shape by: a continuous piece which is bent at an acute angle from corresponding one of both side edges of said stationary contact piece portion to extend in a direction perpendicular to the axial direction of said connector;

a contact piece which extends from said continuous piece in the axial direction of said connector, said contact portion is formed by said stationary contact piece portion and said movable contact piece portions into a triangular shape as seen in the axial direction of said connector;

a cylindrical contact portion of a plug external conductor which is to be in contact with a receptacle outer circumference conductor is provided with a plurality of slits to be split into plural contact piece portions which are elastically displaceable in a radial direction of said connector, said contact portion with respect to the receptacle outer circumference conductor is formed on an inner face of a tip end side of each of said contact piece portions, said contact portion protruding inwardly; and a tip end of said plug body protrudes from a tip end of said plug external conductor.

8. A board-to-board coaxial connector which is configured by one coaxial connector pair comprising:

a coaxial connector receptacle which is to be surface mounted to one printed circuit board; and a coaxial connector plug which is to be surface mounted to another printed circuit board, said coaxial connector receptacle and said coaxial connector plug being fittable with each other, wherein:

a contact portion is formed in an internal conductor housing portion of an insulative plug body into which a pin-like receptacle center conductor is to be inserted, said contact portion has: a stationary contact piece portion which is perpendicularly bent from a solder connecting portion of a plug internal conductor to extend in an axial direction of said connector;

movable contact piece portions which are continuous to said stationary contact piece portion, which are juxtaposed in a circumferential direction of said connector, and which extend in the axial direction of said connector, and, when said receptacle center conductor is inserted into said internal conductor housing portion, said movable contact piece portions are elastically displaced in a direction perpendicular to the axial direction of said connector to be elastically contacted with an outer circumferential face of said receptacle center conductor, together with said stationary contact piece portion;

each of said movable contact piece portions is formed into an L-like shape by: a continuous piece which is bent at an acute angle from corresponding one of both side edges of said stationary contact piece portion to extend in a direction perpendicular to the axial direction of said connector;

a contact piece which extends from said continuous piece in the axial direction of said connector, said contact portion is formed by said stationary contact piece portion and said movable contact piece portions into a triangular shape as seen in the axial direction of said connector, an inner edge of a tip end portion of each of said movable contact piece portions is chamfered to form a guiding face for insertion of said receptacle center conductor in the tip end portion of the movable contact piece portion;

a cylindrical contact portion of a plug external conductor which is to be in contact with a receptacle outer circumference conductor is provided with a plurality of slits to be split into plural contact piece portions which are elastically displaceable in a radial direction of said connector, said contact portion with respect to the receptacle outer circumference conductor is formed on an inner face of a tip end side of each of said contact piece portions, said contact portion protruding inwardly; and a tip end of said plug body protrudes from a tip end of said plug external conductor.

9. A board-to-board coaxial connector which is configured by one coaxial connector pair comprising:

a coaxial connector receptacle which is to be surface mounted to one printed circuit board; and a coaxial connector plug which is to be surface mounted to another printed circuit board, said coaxial connector receptacle and said coaxial connector plug being fittable with each other, wherein:

a contact portion is formed in an internal conductor housing portion of an insulative plug body into which a pin-like receptacle center conductor is to be inserted, said contact portion has: a stationary contact piece portion which is perpendicularly bent from a solder connecting portion of a plug internal conductor to extend in an axial direction of said connector;

movable contact piece portions which are continuous to said stationary contact piece portion, which are juxtaposed in a circumferential direction of said connector, and which extend in the axial direction of said connector, and, when said receptacle center conductor is inserted into said internal conductor housing portion, said movable contact piece portions are elastically displaced in a direction perpendicular to the axial direction of said connector to be elastically contacted with an outer circumferential face of said receptacle center conductor, together with said stationary contact piece portion;

each of said movable contact piece portions is formed into an L-like shape by: a continuous piece which is bent at an acute angle from corresponding one of both side edges of said stationary contact piece portion to extend in a direction perpendicular to the axial direction of said connector;

a contact piece which extends from said continuous piece in the axial direction of said connector, said contact portion is formed by said stationary contact piece portion and said movable contact piece portions into a triangular shape as seen in the axial direction of said connector, a shape of said internal conductor housing portion is substantially identical with an outer shape of said contact portion after elastic displacement when said receptacle center conductor is inserted;

a cylindrical contact portion of a plug external conductor which is to be in contact with a receptacle outer circumference conductor is provided with a plurality of slits to be split into plural contact piece portions which are elastically displaceable in a radial direction of said connector, said contact portion with respect to the receptacle outer circumference conductor is formed on an inner face of a tip end side of each of said contact piece portions, said contact portion protruding inwardly; and a tip end of said plug body protrudes from a tip end of said plug external conductor.

10. A board-to-board coaxial connector which is configured by one coaxial connector pair comprising:

a coaxial connector receptacle which is to be surface mounted to one printed circuit board; and a coaxial connector plug which is to be surface mounted to another printed circuit board, said coaxial connector receptacle and said coaxial connector plug being fittable with each other, wherein:

a contact portion is formed in an internal conductor housing portion of an insulative plug body into which a pin-like receptacle center conductor is to be inserted, said contact portion has: a stationary contact piece portion which is perpendicularly bent from a solder connecting portion of a plug internal conductor to extend in an axial direction of said connector;

movable contact piece portions which are continuous to said stationary contact piece portion, which are juxtaposed in a circumferential direction of said connector, and which extend in the axial direction of said connector, and, when said receptacle center conductor is inserted into said internal conductor housing portion, said movable contact piece portions are elastically displaced in a direction perpendicular to the axial direction of said connector to be elastically contacted with an outer circumferential face of said receptacle center conductor, together with said stationary contact piece portion;

each of said movable contact piece portions is formed into an L-like shape by: a continuous piece which is bent at an acute angle from corresponding one of both side edges of said stationary contact piece portion to extend in a direction perpendicular to the axial direction of said connector;

a contact piece which extends from said continuous piece in the axial direction of said connector, said contact portion is formed by said stationary contact piece portion and said movable contact piece portions into a triangular shape as seen in the axial direction of said connector, an inner edge of a tip end portion of each of said movable contact piece portions is chamfered to form a guiding face for insertion of said receptacle center conductor in the tip end portion of the movable contact piece portion, a shape of said internal conductor housing portion is substantially identical with an outer shape of said contact portion after elastic displacement when said receptacle center conductor is inserted;

a cylindrical contact portion of a plug external conductor which is to be in contact with a receptacle outer circumference conductor is provided with a plurality of slits to be split into plural contact piece portions which are elastically dis-placeable in a radial direction of said connector, said contact portion with respect to the receptacle outer circumference conductor is formed on an inner face of a tip end side of each of said contact piece portions, said contact portion protruding inwardly; and a tip end of said plug body protrudes from a tip end of said plug external conductor.

* * * * *

UNITED STATES PATENT AND TRADEMARK OFFICE

CERTIFICATE OF CORRECTION

PATENT NO. : 7,118,383 B2
APPLICATION NO. : 11/189706
DATED : October 10, 2006
INVENTOR(S) : Nagata et al.

It is certified that error appears in the above-identified patent and that said Letters Patent is hereby corrected as shown below:

Please make the following corrections in the claims:

Claim 2, column 15, line 16, the word "mov-able" should be corrected to read as:

-- movable --

Claim 10, column 22, line 17, the word "dis-placeable" should be corrected to read as:

-- displaceable --

Signed and Sealed this

First Day of May, 2007

JON W. DUDAS
*Director of the United States Patent and Trademark Office*